US012144373B2

(12) United States Patent
Bouchuiguir et al.

(10) Patent No.: US 12,144,373 B2
(45) Date of Patent: Nov. 19, 2024

(54) AEROSOL GENERATION DEVICE HAVING A MOVEABLE CLOSURE WITH A DETECTOR

(71) Applicant: JT International S.A., Geneva (CH)

(72) Inventors: Layth Sliman Bouchuiguir, Bellevue (CH); Jon Mason, London (GB); Nathan Lyell, Woking (GB); Marko Plevnik, London (GB)

(73) Assignee: JT International S.A. (CH)

( * ) Notice: Subject to any disclaimer, the term of this patent is extended or adjusted under 35 U.S.C. 154(b) by 431 days.

(21) Appl. No.: 17/608,054

(22) PCT Filed: Apr. 30, 2020

(86) PCT No.: PCT/EP2020/062072

§ 371 (c)(1),
(2) Date: Nov. 1, 2021

(87) PCT Pub. No.: WO2020/225105

PCT Pub. Date: Nov. 12, 2020

(65) Prior Publication Data

US 2022/0225675 A1 Jul. 21, 2022

(30) Foreign Application Priority Data

May 3, 2019 (EP) ..... 19172661
Feb. 18, 2020 (EP) ..... 20158043

(51) Int. Cl.
*A24F 40/42* (2020.01)
*A24F 40/51* (2020.01)
*A24F 40/53* (2020.01)

(52) U.S. Cl.
CPC ..... *A24F 40/42* (2020.01); *A24F 40/51* (2020.01); *A24F 40/53* (2020.01)

(58) Field of Classification Search
CPC ..... A24F 40/42; A24F 40/40; A24F 40/10; A24F 40/20; A24F 40/53; A24F 40/51; A24F 40/50
See application file for complete search history.

(56) References Cited

U.S. PATENT DOCUMENTS 9,408,416 B2 * 8/2016 Monsees ..... A61M 15/06
10,244,791 B2 * 4/2019 Cameron ..... B05B 12/12
(Continued)

FOREIGN PATENT DOCUMENTS

CN 106572700 A 4/2017
CN 106572708 A 4/2017
(Continued)

OTHER PUBLICATIONS

Search Report dated Jan. 18, 2024 from the Office Action for Chinese Application No. 202080031806.0 issued Jan. 19, 2024, 3 pages.

(Continued)

*Primary Examiner* — Harshad C Patel
(74) *Attorney, Agent, or Firm* — Lerner David LLP

(57) ABSTRACT

An aerosol generation device includes a casing; an aperture in the casing through which aerosol generating material is insertable into the aerosol generation device; a closure moveable relative to the aperture between a closed position in which the closure covers the aperture, an open position in which the aperture is unobstructed by the closure, and an activation position that is different from the open position; and a detector arranged to detect movement of the closure from the closed position to the open position and between the open position and the activation position.

17 Claims, 17 Drawing Sheets

(56) References Cited

U.S. PATENT DOCUMENTS

| | | | | |
|---|---|---|---|---|
| 2013/0042865 | A1 | 2/2013 | Monsees et al. | |
| 2013/0312742 | A1* | 11/2013 | Monsees | A24F 40/60 128/202.21 |
| 2014/0053856 | A1 | 2/2014 | Liu | |
| 2015/0259171 | A1* | 9/2015 | Campanini | B65H 35/008 225/23 |
| 2016/0235122 | A1 | 8/2016 | Krietzman | |
| 2016/0235124 | A1* | 8/2016 | Krietzman | H05B 3/42 |
| 2016/0338412 | A1* | 11/2016 | Monsees | H05B 3/146 |
| 2016/0377156 | A1* | 12/2016 | Robles | F16H 7/06 475/269 |
| 2017/0057173 | A1* | 3/2017 | van der Zalm | B33Y 50/02 |
| 2017/0150756 | A1* | 6/2017 | Rexroad | H05B 1/0244 |
| 2017/0196263 | A1 | 7/2017 | Sur | |
| 2017/0222468 | A1 | 8/2017 | Schennum et al. | |
| 2017/0231285 | A1* | 8/2017 | Holzherr | A24F 40/95 131/329 |
| 2017/0304567 | A1* | 10/2017 | Adelson | A61M 11/042 |
| 2018/0132528 | A1 | 5/2018 | Sur et al. | |
| 2018/0303283 | A1* | 10/2018 | Kollep | A47J 31/52 |
| 2020/0093185 | A1* | 3/2020 | Lim | A24F 40/53 |
| 2020/0205475 | A1 | 7/2020 | Zeng et al. | |
| 2020/0221782 | A1 | 7/2020 | Lim | |
| 2020/0375251 | A1 | 12/2020 | Borges et al. | |

FOREIGN PATENT DOCUMENTS

| | | | |
|---|---|---|---|
| CN | 106901404 | A | 6/2017 |
| CN | 206687163 | U | 12/2017 |
| CN | 107692317 | A | 2/2018 |
| CN | 108463127 | A | 8/2018 |
| CN | 108552611 | A | 9/2018 |
| EP | 3632240 | A1 | 4/2020 |
| EP | 3669679 | A1 | 6/2020 |
| JP | 2020527053 | A | 9/2020 |
| JP | 2021515539 | A | 6/2021 |
| WO | 2018216961 | A1 | 11/2018 |
| WO | 2019047955 | A1 | 3/2019 |

OTHER PUBLICATIONS

International Search Report for Application No. PCT/EP2020/062072, dated Aug. 3, 2020, 5 pages.

* cited by examiner

AEROSOL GENERATION DEVICE HAVING A MOVEABLE CLOSURE WITH A DETECTOR

CROSS-REFERENCE TO RELATED APPLICATIONS

The present application is a national phase entry under 35 U.S.C. § 371 of International Application No. PCT/EP2020/062072, filed Apr. 30, 2020, published in English, which claims priority to European Application No. 20158043.8 filed Feb. 18, 2020 and European Application No. 19172661.1 filed May 3, 2019, all of the disclosures of which are incorporated herein by reference.

FIELD OF THE INVENTION

The present disclosure relates to an aerosol generation device having a movable closure with a detector for detecting movement of the closure. The disclosure is particularly, but not exclusively, applicable to a portable aerosol generation device, which may be self-contained and low temperature. Such devices may heat, rather than burn, tobacco or other suitable materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is a heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

In general terms it is desirable to rapidly heat the aerosol substrate to, and to maintain the aerosol substrate at, a temperature at which an aerosol may be released therefrom. It will be apparent that the aerosol will only be released from the aerosol substrate and delivered to the user when there is air flow passing through the aerosol substrate.

It is generally desirable to allow the user to control certain functionality of the aerosol generation device, for example turning the device on or off, starting a "smoking" session by activating a heater and changing settings or configurations of the aerosol generation device. This has led to aerosol generation devices having relatively complex or unwieldy user interfaces comprising a plurality of buttons and visual indicators.

Aerosol generation devices occasionally comprise closures that cover an opening in the device, such as an opening through which access may be gained to a heating chamber for inserting the aerosol substrate for use. In general, these covers add to the complexity of using the device, as the cover must usually be moved away from the opening before the device can be used.

SUMMARY OF THE DISCLOSURE

Aspects of the disclosure are set out in the accompanying claims.

According to an aspect of the disclosure, there is provided an aerosol generation device comprising: a casing; an aperture in the casing through which aerosol generating material is insertable into the aerosol generation device; a closure moveable relative to the aperture between a closed position in which the closure covers the aperture, an open position in which the aperture is unobstructed by the closure, and an activation position that is different from the open position; and a detector arranged to detect movement of the closure from the closed position to the open position and between the open position and the activation position.

The detector may allow the closure (or door) position to be detected. This detection may be used to generate control signals for operating the aerosol generation device. Advantageously, the detector may therefore allow a user to interact with the aerosol generation device via the closure. By detecting the movement of the closure between (e.g. arrival at or departure from) the open and closed positions and between the open and activation positions, at least two user inputs may be distinguished by the detector. Typically, the activation position is different from the closed position.

Optionally, the detector is configured to interact with a sensing element to perform the detection. The detector may be mounted on the casing and the sensing element may be mounted on the closure. Alternately, the detector may be mounted in the casing and the sensing element may be mounted on the casing.

Optionally, the detector comprises a contactless sensor for detecting at least one of the movement of the closure from the closed position to the open position or from the open position to the activation position contactlessly.

Optionally, the contactless sensor is a Hall effect sensor and the sensing element comprises one or more magnetic elements.

Optionally, the contactless sensor is a photodetector and the sensing element is the closure and the closure covers the detector in the open position and preferably in the activation position.

Optionally, the closure or casing has an acoustic element arranged to emit a sound when the closure moves from the closed position to the open position and preferably when the closure moves from the open position to the activation position, and the contactless sensor is an acoustic sensor.

Optionally, the contactless sensor is a light responsive proximity sensor, preferably an infra-red sensor and the sensing element is at least one light reflective element.

Optionally, the contactless sensor is an inductive sensor and the sensing element is at least one conductive element.

Optionally, the contactless sensor is an ultrasound sensor and the sensing element is at least one acoustically reflective element.

Optionally, the detector comprises an activation sensor configured to detect the movement closure from the open position to the activation position, from the activation position to the open position or when the closure is in the activation position.

Optionally, the activation detector is any one of: a tactile switch, a slider switch, force sensitive resistor, a capacitive touch sensor, a rotary encoder, two Hall effect sensors, a rocker switch, electrical continuity detector and preferably a tactile switch.

Optionally, the aerosol generation device comprises a detector module configured to receive signals indicative of the position of the closure from the detector.

Optionally, the aerosol generation device is configured to be in an off mode when the closure is in the closed position, to be in a standby mode when the closure is in the open position or moves to the open position, and to be in an activation mode when the closure is in the activation position or moves to or returns from the activation position.

Optionally, when in the standby mode, the aerosol generation device comprises a user interface display to display the current battery level.

Optionally, when in the activation mode, the aerosol generation device is configured to permit heating the aerosol generating material loaded via the aperture.

Optionally, the detector comprises an electrical conductivity sensor and the sensing element comprises two conductive elements.

Optionally, the closure is moveable into a further activation position, different to the (first) activation position. Preferably, the detector is further arranged to detect movement of the closure from the closed position to the further activation position.

Optionally, the detector comprises a further activation sensor configured to detect the movement of closure from the closed position to the further activation position, from the further activation position to the closed position, or when the closure is in the further activation position. Preferably, the further activation sensor is any one or more of the following: a tactile switch, a slider switch, force sensitive resistor, a capacitive touch sensor, a rotary encoder, a Hall effect sensor, two Hall effect sensors, a rocker switch, or an electrical contact arrangement. More preferably the further activation sensor is a tactile switch.

According to a further aspect of the disclosure there is provided an aerosol generation device comprising a casing; an aperture in the casing through which aerosol generating material is insertable into the aerosol generation device; a closure moveable relative to the aperture between a closed position in which the closure covers the aperture and an open position in which the aperture is unobstructed by the closure; and a detector comprising a contactless sensor arranged to detect movement of the closure from the closed position to the open position.

Optionally, the aerosol generation device is configured to be in an off mode when the closure is in the closed position and to be in a standby mode when the closure is in the open position or moves to the open position.

Optionally, the aerosol generation device comprises a button, and the aerosol generation device is configured to be in an activation mode only when the closure is in the open position and the button is activated. In one example, the aerosol generation device is configured to enter into the activation mode only when the button is actuated whilst the closure is in the open position. In other examples, the aerosol generation device is configured to enter into the activation mode after both the button is actuated and the closure moves to the open position irrespective of the order of the actuation and movement. Overall, activation of the button is required in order to enter the device into the activation mode, rather than just movement of the closure (as in some other embodiments).

Optionally, the button is configured to be activated by manual actuation, preferably by pressing and/or by holding the button for a predetermined period of time, e.g. a period of time exceeding a threshold period of time stored by the aerosol generation device. The button may be positioned at a location spaced apart from the closure. Typically, the button is located on an outer surface of the aerosol generation device, e.g. on a casing of the aerosol generation device. In one example, the closure is located at one end of the aerosol generation device and the button is located on a side wall of the aerosol generation device.

Optionally, the aerosol generation device comprises a heating chamber for heating the aerosol generating material to an aerosol generation temperature.

Optionally, when in the activation mode, the aerosol generation device is configured to activate the heating chamber.

Optionally, when in the standby mode, the aerosol generation device is configured to carry out a battery level checking function. The battery level checking function may comprise displaying a charge level of a battery of the aerosol generation device on a user interface of the aerosol generation device. The user interface may comprise an array of LEDs. A number of the LEDs in the array that illuminate may be proportional to the charge level of the battery.

Optionally, the aerosol generation device may be configured to disable the battery level checking function when the battery is being charged. This may be when the battery is connected to a charger adapted to charge the battery and the battery is not fully charged.

Optionally, the aerosol generation device is configured to enable the battery level checking function when the battery is reaches full charge or is disconnected from the charger.

Each of the aspects above may comprise any one or more features mentioned in respect of the other aspects above. In particular, the various sensors described herein may be used in conjunction with any of the embodiments described herein.

Use of the words "apparatus", "device", "processor", "module" and so on are intended to be general rather than specific. Whilst these features of the disclosure may be implemented using an individual component, such as a computer or a central processing unit (CPU), they can equally well be implemented using other suitable components or a combination of components. For example, they could be implemented using a hard-wired circuit or circuits, e.g. an integrated circuit, and using embedded software.

It should be noted that the term "comprising" as used in this document means "consisting at least in part of". So, when interpreting statements in this document that include the term "comprising", features other than that or those prefaced by the term may also be present. Related terms such as "comprise" and "comprises" are to be interpreted in the same manner. As used herein, "(s)" following a noun means the plural and/or singular forms of the noun.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

Preferred embodiments are now described, by way of example only, with reference to the accompanying drawings.

DETAILED DESCRIPTION OF PREFERRED EMBODIMENTS

First Embodiment

Referring to FIGS. 1A, 1B, 1C, and 1D according to a first embodiment of the disclosure, an aerosol generation device 100 comprises a casing 102 housing various components of the aerosol generation device 100. The casing 102 comprises an aperture 104 and a closure 106. The aperture 104 and closure 106 are both positioned at a first end of the casing 102. The closure 106 is configured selectively to obscure and not to obscure the aperture 104, such that the aperture 104 is substantially not open and open to block or allow the user access to the aperture 104. The closure 106 can also be considered a door for the aperture 104.

Figure 1A:
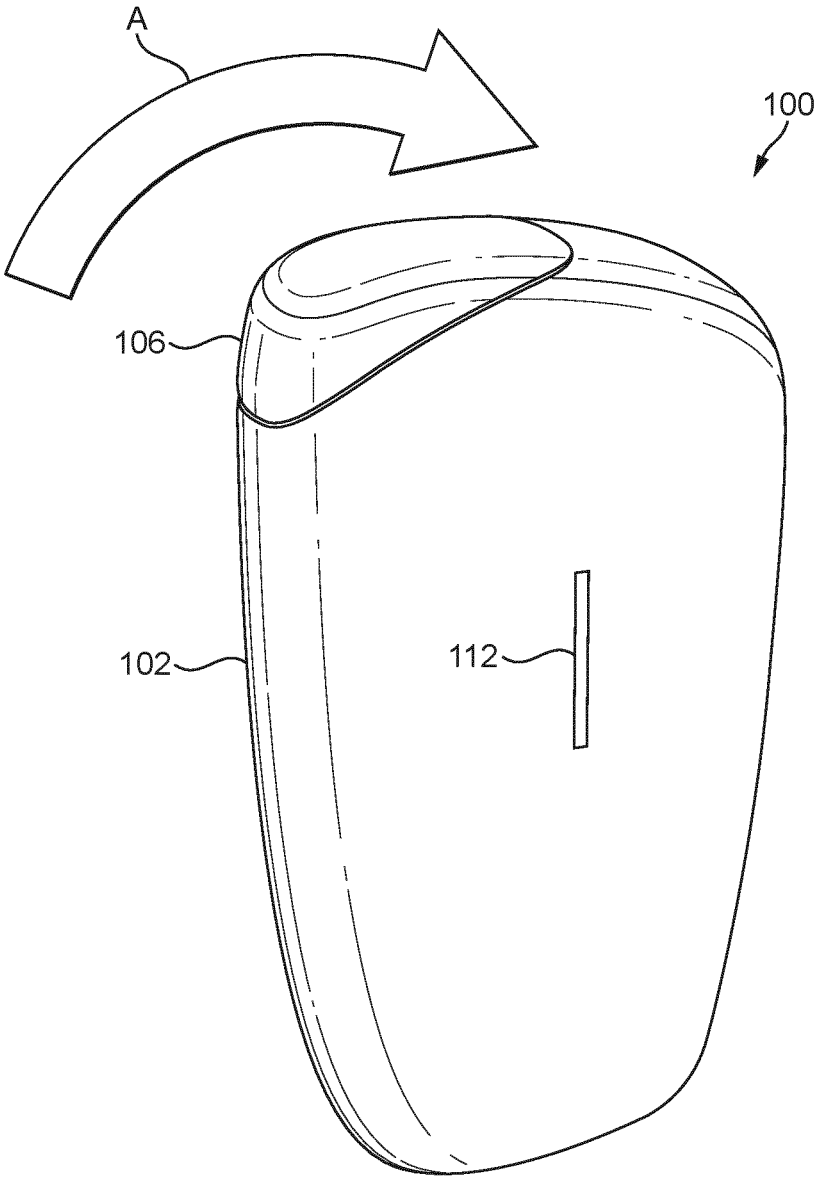
FIG. 1A and FIG. 1B are schematic illustrations of a casing for an aerosol generation device of a first embodiment of the disclosure, in a first position and in a second position.
Figure 1B:
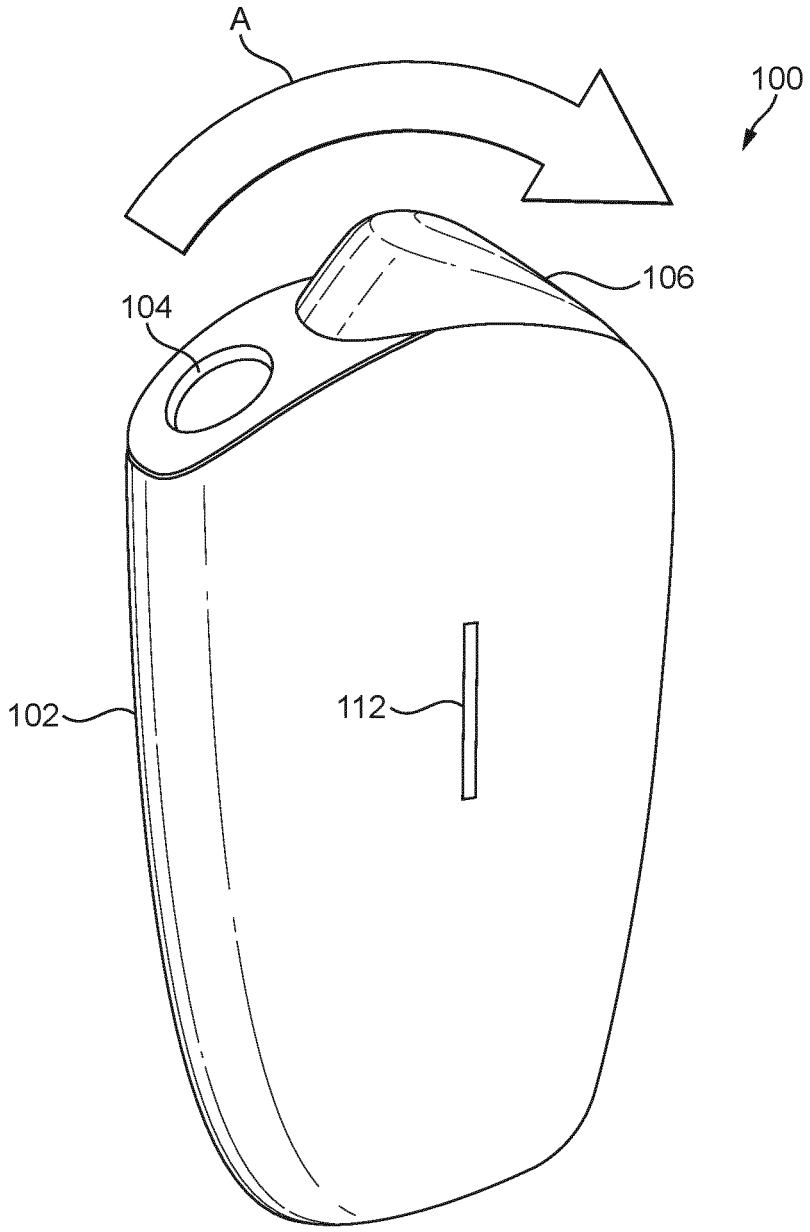
Figure 1C:
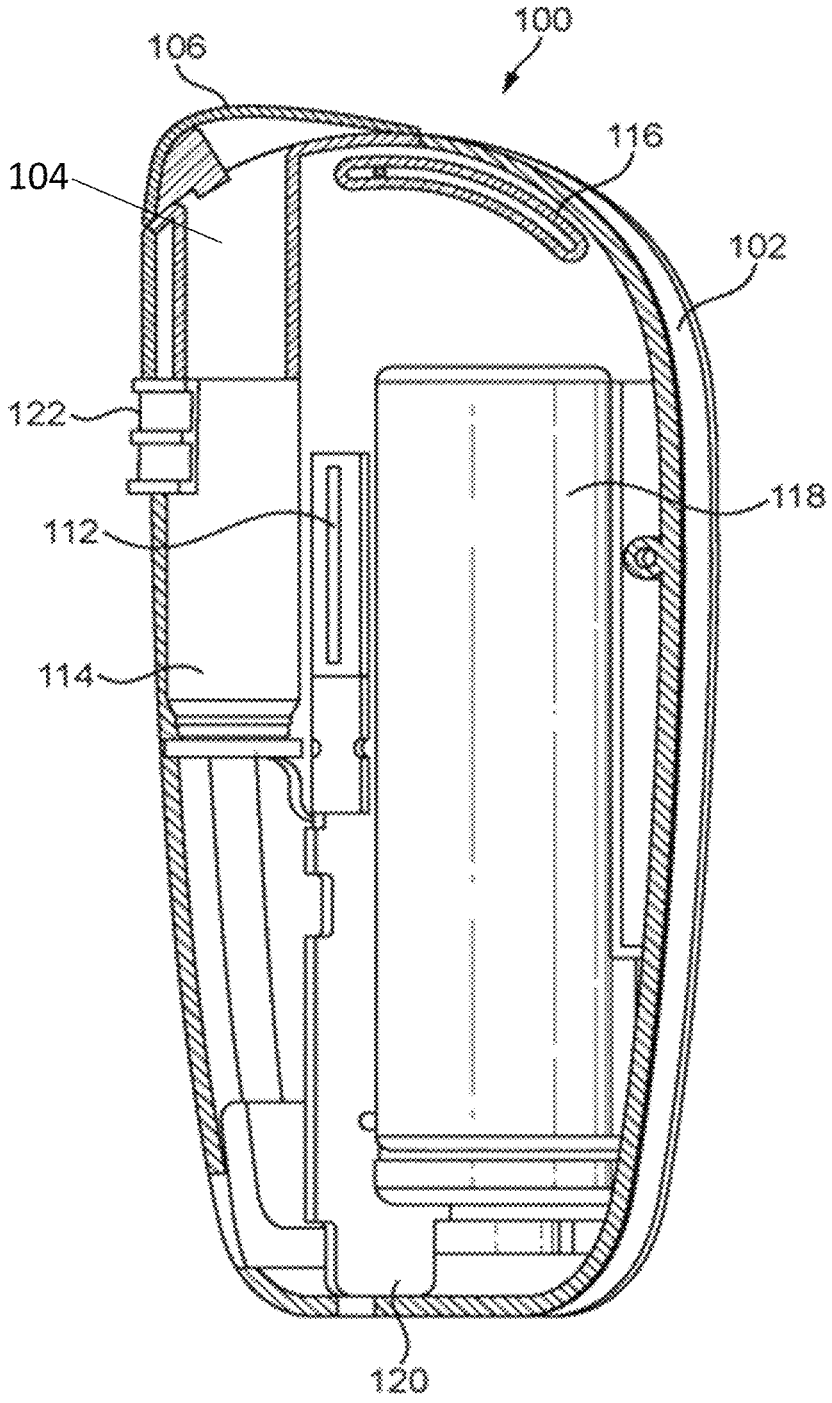
FIG. 1C and FIG. 1D are cut away schematic illustrations of the aerosol generation device of the first embodiment, in a first position and in a second position.
Figure 1D:
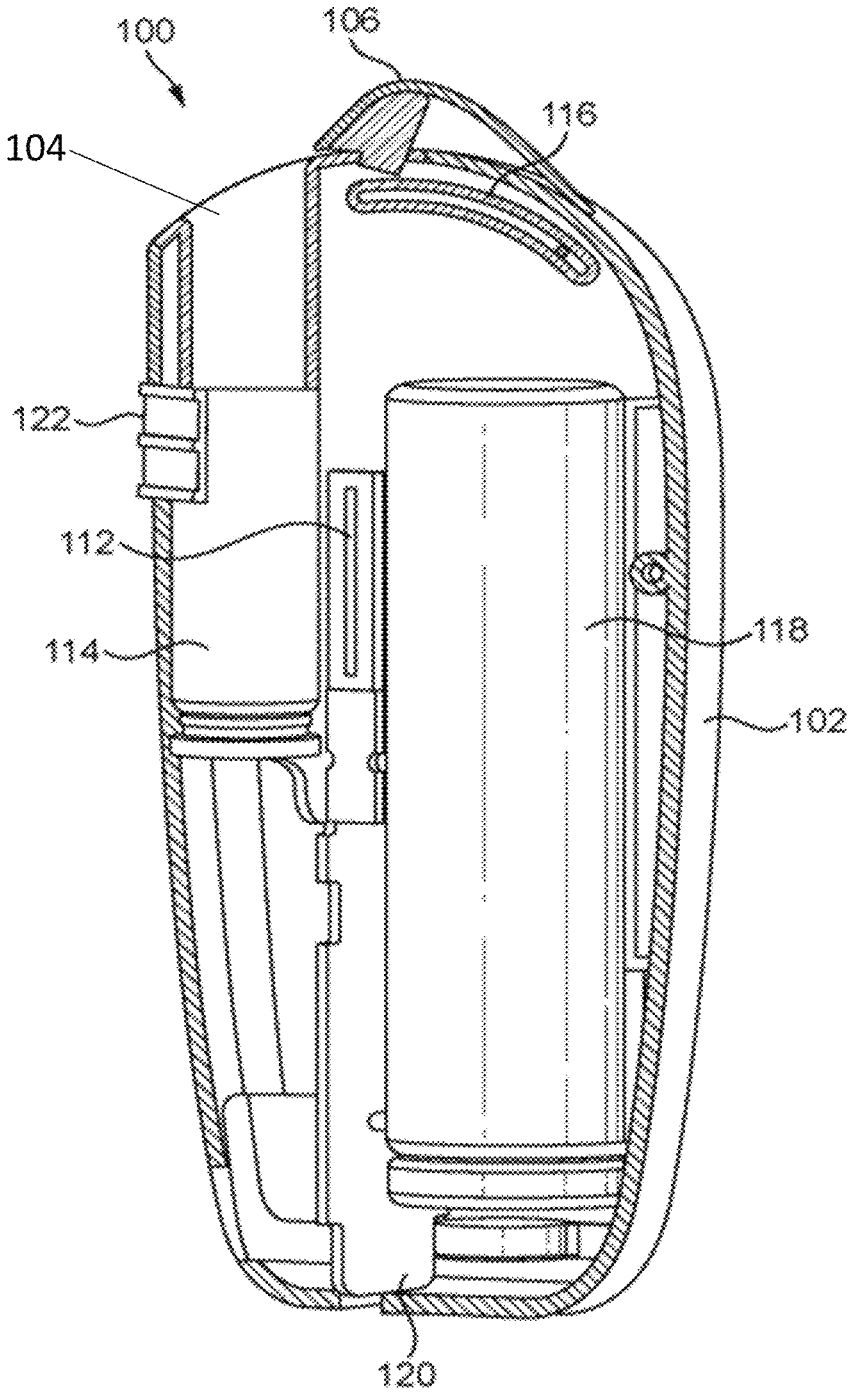

FIGS. 1C and 1D show the aerosol generation device 100 with some of the structural components removed such as the front section of the casing 102 and PCB support structures. These have been removed to show the insides of the aerosol generation device 100 unobstructed.

The aerosol generation device 100 may comprise a display interface 112, a heating chamber (or oven) 114, a carriage 116 of the closure 106, a battery 118, PCB 120, and a heatsink 122. The heating chamber 114 is accessible through the aperture 104. That is to say that the aperture 104 is aligned with an open end of the heating chamber 114, such that when the closure 106 allows access to the aperture 104, the interior of the heating chamber 114 is also accessible.

The closure 106 is configured to move between a first and a second position. The closure 106 is configured to move along the first end of the casing 102. The movement of the closure 106 is according to the arrow A in FIG. 1A and FIG. 1B. The first position of the closure 106, as shown in FIG. 1A, is a closed position in which the aperture 104 is covered or obstructed at least partially. Preferably the aperture 104 is substantially completely covered by the closure 106 when the closure 106 is in the first position.

The second position of the closure 106, as shown in FIG. 1B, is an open position in which the aperture 104 is substantially not covered or not obstructed or unobstructed by the closure 106. When the closure 106 is in the second position, the closure 106 is not obscuring the aperture 104 and a user is able to access the aperture 104. In other words, when the closure 106 is in the second position, the aperture 104 and the heating chamber 114 are accessible.

In some embodiments, when the closure 106 is in the first position, the closure 106 is configured to prevent dust from entering the aperture 104.

In some embodiments, when the closure 106 is in the first position, the closure 106 creates a seal over the aperture 104.

The aperture 104 is configured to receive a consumable (not shown) when not obscured by the closure 106 or when the closure 106 is in the second position. Specifically, the aperture 104 provides an opening through which the consumable can be inserted into the aerosol generation device 100. In this embodiment, the consumable is an aerosol generating material. A user places the consumable into the aerosol generation device 100 via the aperture 104. The consumable is received in a heating chamber 114 within the casing 102 of the aerosol generation device 100. The heating chamber 114 is configured to aerosolise the consumable. For example, the heating chamber 114 may be arranged to transfer heat (e.g. by conduction, convection or radiation) from a heater (not shown) to the consumable. The heating chamber 114 may be arranged to ensure that this heat transfer is both effective and efficient.

The closure 106 is further configured to move to a third position (not shown in FIGS. 1A, 1B, 1C, and 1D). The third position is an "activation position". From the second position, the user operates the closure 106 to enter the third position. The third position can be used to activate the aerosol generating device 100 and trigger the process for heating the consumable and generating aerosol for a user to inhale. As noted above, this activation process may for example involve supplying heat to the heating chamber 114 in order to volatilise or aerosolise parts of the consumable.

In some examples, the third position of the closure 106 is a depressed position relative to the casing 102. After the user has slid the closure 106 between the first and second positions and the closure 106 is in the second position, the user then presses the closure 106 down towards the casing 102. The third position is when the closure 106 has been depressed past or up to a certain boundary mark. Moving into the third position is considered moving past or up to the third position boundary mark. The third position may only be a temporary position for the closure 106 to be in. For example, the closure 106 may be biased in a direction from the third position towards the second position so that a constant force is required to be exerted upon the closure 106 in order to retain the closure 106 in the third position; in the absence of such a constant force, the closure 106 returns to the second position.

In the third position, the closure 106 does not obscure the aperture 104 as with the second position. For example, in cases where movement into the third position triggers activation of the aerosol generation device 100 to supply heat to a consumable, a part of the consumable through which aerosol may be drawn by a user (e.g. a mouthpiece portion) may extend outside the outer envelope of the casing 102 as described in more detail below. This means that the third position to activate heating of the consumable should also not obscure the aperture 104, in order that the activation can occur without damaging the protruding portion of the consumable.

In an alternative embodiment, when the closure 106 is in the third position it covers the aperture 104. This way, a user moves the closure 106 from the first position to the second position then loads a consumable through the aperture 104. Then the user moves the closure 106 from the second position to the third position. Alternatively, the closure 106 moves into the third (activation) position from the first (closed) position. In either alternative embodiment, when the closure 106 is in the third position, the closure 106 covers the aperture 104 and a user is unable to interact with the consumable via the aperture 104. The third position of the closure 106 is similar to the first position in that it is a closed position also. This provides advantages in that the user cannot interact with the consumable and interrupt any heating process or other process of the consumable. Further, with the aperture 104 covered, the consumable will be completely or at least more blocked from the surrounding environment. By (partially or completely) blocking off the environment from the consumable, a more controlled and/or efficient heating or processing of the consumable is possible. The effect of wind, temperature or other environmental factors will be reduced or alleviated completely. In such alternative embodiments where the protrusion cannot remain protruding through the aperture 104 when the closure is in the third position because the closure 106 blocks the aperture 104, an alternative air flow path is provided to allow the user to draw out aerosol from the heating chamber 114 once the aerosol has been generated, for example by heating as described above.

In a further alternative embodiment, once the closure 106 is in the second position, the user moves the closure 106 to a further alternative third position along the same path as used to move from the first to the second position. That is to say, the translation from the second position to the third position is a translation in the same direction as the translation from the first position to the second position, further along arrow A. The closure 106 moves from the first to the second and the second to the third position by the user translating the closure 106. In this way, a mechanism is used to provide three stable positions for the closure 106 along the same axis (or curved path) where the first position is next to the second position and the second position is next to the third position. The mechanism may be a resilient arrangement such as a spring arrangement, or other suitable biasing means.

A detector (examples and embodiments of which are described in more detail with reference to FIGS. 2 to 19) is arranged to detect movement or position of the closure 106. The detector may be configured to detect movement or position of the closure 106 contactlessly. The detector may be configured to detect movement or position of the closure 106 in the first and second positions contactlessly. The detector is arranged to detect movement of the closure 106 between the first position and the second position (and optionally also between the second position and the third position in cases where there is a third position). In an alternative embodiment, the detector is arranged to detect the absolute position of the closure 106. In a further alternative embodiment, the detector is configured to measure when the closure 106 is in the first, second, or third position.

A person skilled in the art will appreciate that movement of the closure 106 and position of the closure 106 are directly related and by knowing one of either the position or the movement of the closure 106, the other can be inferred. Specifically, while examples disclose detection of the position of the closure 106, it will be appreciated that the movement of the closure 106 can be inferred by the detector module 160 (described in greater detail below) by knowing the position of the closure 106. The reverse is also true. By knowing where the closure 106 is moving and which direction it is moving the detector module 160 can infer the position the closure 106 is in or will be in very shortly.

To detect movement or position of the closure, the detector comprises a sensor 110. The sensor 110 is configured to sense the movement or position of the closure 106. The sensor 110 is preferably a contactless sensor.

The sensor 110 may be located in the casing 102 or the closure 106. The sensor 110 is configured to detect or sense at least one sensing element. The sensing element is located in the opposite of where the sensor 110 is out of the casing 102 or closure 106. In other words, if the sensor 110 is located in the casing 102, then the sensing element is located in the closure 106 (or vice-versa). In other words the sensor 110 is located respectively on the closure 106 or on the casing 102 and is configured to detect or sense the sensing element respectively located on the casing 102 or closure 106.

Alternatively, the detector acts as a position sensor for the closure 106. The detector is configured to determine the position of the closure 106. The detector is configured to output a signal indicative of the position of the closure 106.

In some embodiments, the detector acts as a proximity sensor and the detector is configured to measure the distance of the closure 106 from the detector. The distance between the detector and the closure 106 is indicative of the position the closure 106 is in. The first, second, and third positions of the closure 106 all have different distances from the detector. For example, when the closure 106 is far away from the detector, the distance is indicative of the closure 106 being in the first position. When the closure 106 is in the second position, the closure 106 is positioned closer to the detector. The detector detects the shorter distance. The third position of the closure 106 is closer to the detector than the other positions. The same is true but in reverse if the detector is in the closure 106 and the sensing element is in the casing 102. In some cases, the proximity sensor may detect a strength of signal (e.g. magnetic field strength) output by the sensing element, with a weaker signal indicating a larger distance between the proximity sensor and the sensing element.

In an alternative embodiment, the detector comprises one sensor used for each position of the closure 106. The sensor may be any one of the sensors described with reference to FIGS. 2 to 19. In such cases, the sensors may be used to detect which position the closure 106 is in, for example at most only one sensor may be triggered at any given time, indicating that the closure 106 is in the position being monitored by that sensor. Where none of the sensors are being triggered at any given time, this may be indicative of the closure 106 being between positions, for example part way through a transition between positions. In some examples sensors may be provided to detect the closure being in transition between the first, second or third positions.

The detector is arranged to detect movement of the closure 106 from the second position to the third position. With reference to FIGS. 8 to 19, the detector comprises a further sensor 800. When the closure 106 moves from the second position to the third position, the further sensor 800 detects the movement of the closure 106. The further sensor 800 may also be considered an activation detector or activation sensor.

In many of the embodiments presented in this disclosure, the further sensor 800 is located in the casing 102. It will be appreciated that these are examples and that the further sensor 800 may also be located in (or on) the closure 106. Similarly, in the examples herein in which the further sensor 800 is presented as being located in the closure 106, it will be appreciated that an alternative embodiment of that example would be to provide the further sensor 800 in the casing 102 instead.

In an alternative embodiment, the detector is configured to detect the movement of the closure 106 from the second position to the third position using any one or more of the sensors 110 as described with reference to FIGS. 2 to 7. In this way, the detector can contactlessly detect any of the positions the closure 106 is in or movements the closure 106 makes.

The detector module 160 of the aerosol generation device 100 is configured to manage the detector. That is, the detector module 160 of the aerosol generation device 100 is configured to receive signal indicative of the sensor 110 and further sensor 800 (if present in the embodiment).

The casing 102 has a substantially round edged rectangular prism shape. Note that the casing 102 need not have a substantially rectangular prism shape, but could be any shape so as to fit the internal components described in the various embodiments set out herein, the aperture 104 and the closure 106. In particular, the casing 102 is any shape to allow the closure 106 to move from the first to second position in order to open or close access to the aperture 104. The casing 102 can be formed of any suitable material, or indeed layers of material. For example the casing 102 comprises an inner layer and an outer layer. The inner layer is made of metal. The inner layer is surrounded by the outer layer made of plastic. This allows the casing 102 to be pleasant for a user to hold. Any heat leaking out of the aerosol generation device 100 is distributed around the casing 102 by the layer of metal, so preventing hotspots, while the layer of plastic softens the feel of the casing 102. In addition, the layer of plastic can help to protect the layer of metal from tarnishing or scratching, so improving the long term look of the aerosol generation device 100.

During use, the user typically orients the aerosol generation device 100 with the first end in a proximal position with respect to the user's mouth. The consumable comprises a mouth end portion. When the closure 106 is in the second or third position, the mouth end portion preferably extends out of the casing 102 via the aperture 104 for a user to place their mouth on to consume the consumable.

Figure 1E:
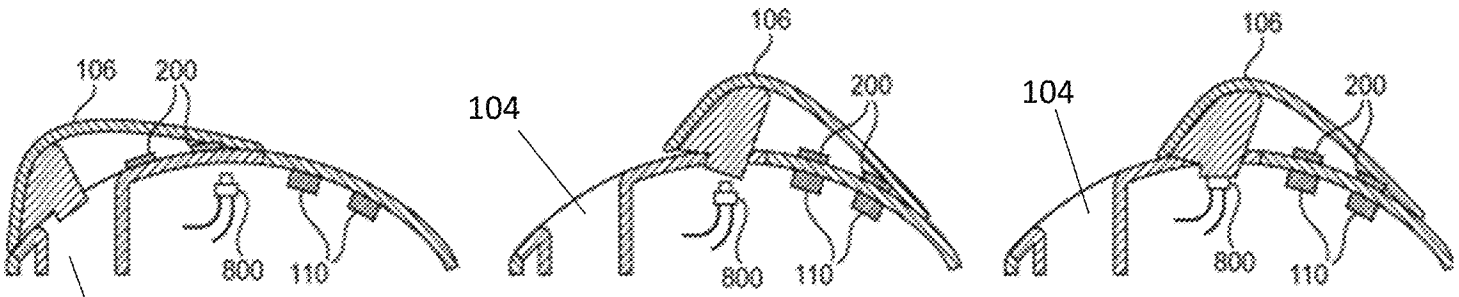
FIG. 1E is a schematic cross-sectional view of a closure and assembly of the aerosol generation device of the first embodiment with the closure in the first, second and a third position respectively.
Figure 1F:
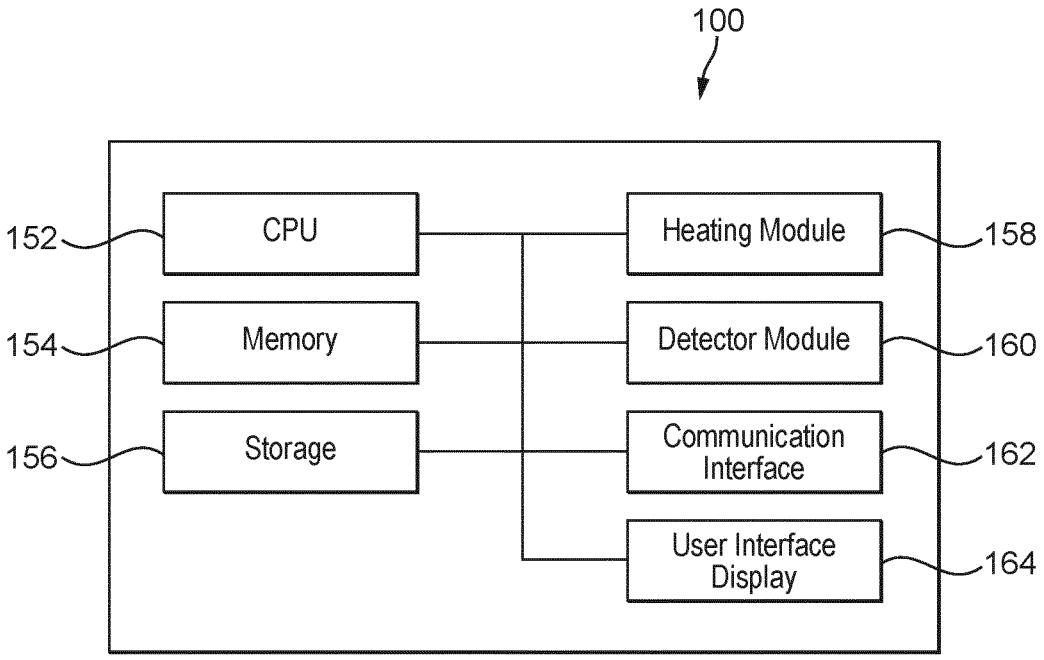
FIG. 1F is a system module view of the aerosol generation device of the first embodiment.

Referring to FIG. 1F, the aerosol generation device 100 comprises a Central Processing Unit (CPU) 152, memory 154, storage 156, a heater module 158, a detector module 160, a communication interface 162, user interface display 164, and a communication bus. The aerosol generation device 100 also has aerosol generation components, in particular a heater module 158. It should be noted that several of the embodiments described below are applicable to other types of consumer apparatus, which typically have the computer related components but not the aerosol generation components of the aerosol generation device 100. It should therefore be understood that, in the context of those methods, the described aerosol generation device 100 is just one example of an appropriate consumer apparatus for use with the embodiments.

The CPU 152 is a computer processor, e.g. a microprocessor. It is arranged to execute instructions in the form of computer executable code, including instructions stored in the memory 154 and the storage 156. The instructions executed by the CPU 152 include instructions for coordinating operation of the other components of the aerosol generation device 100, such as instructions for controlling the communication interface 162.

The memory 154 is implemented as one or more memory units providing Random Access Memory (RAM) for the aerosol generation device 100. In the illustrated embodiment, the memory 154 is a volatile memory, for example in the form of an on-chip RAM integrated with the CPU 152 using System-on-Chip (SoC) architecture. However, in other embodiments, the memory 154 is separate from the CPU 152. The memory 154 is arranged to store the instructions processed by the CPU 152, in the form of computer executable code. Typically, only selected elements of the computer executable code are stored by the memory 154 at any one time, which selected elements define the instructions essential to the operations of the aerosol generation device 100 being carried out at the particular time. In other words, the computer executable code is stored transiently in the memory 154 whilst some particular process is handled by the CPU 152. As an example, the power delivered to the heating module 158 for operating a heater to aerosolise parts of the consumable, and the timing of the delivery of such power can be stored in the memory, so that the CPU 152 can control the heating module 158 when the device 100 is activated.

The storage 156 is provided integrally with the aerosol generation device 100, in the form of a non-volatile memory. The storage 156 is in most embodiments embedded on the same chip as the CPU 152 and the memory 154, using SoC architecture, e.g. by being implemented as a Multiple-Time Programmable (MTP) array. However, in other embodiments, the storage 156 is an embedded or external flash memory, or such like. The storage 156 stores computer executable code defining the instructions processed by the CPU 152. The storage 156 stores the computer executable code permanently or semi-permanently, e.g. until overwritten. That is, the computer executable code is stored in the storage 156 non-transiently. Typically, the computer executable code stored by the storage 156 relates to instructions fundamental to the operation of the CPU 152, communication interface 162, and the aerosol generation device 100 more generally, as well as to applications performing higher-level functionality of the aerosol generation device 100 and data relating to such applications.

The detector module 160 is coupled to the detector. The detector module 160 receives signals indicative of the position, status or movement of the closure 106 and provides signals indicative of the position, status, and/or movement of the closure 106 to the CPU 152. For example, when the closure 106 is in the third position, the detector module 160 will interrupt the CPU 152 to inform the CPU 152 that the closure 106 is in the third position. In this example, the CPU 152 is configured to enable the heater module 158 to generate aerosol and therefore enable a user to inhale the aerosol.

The communication interface 162 supports short-range wireless communication, in particular Bluetooth® communication. In particular, the communications interface 162 is configured to establish a short-range wireless communication connection with a personal computing device of the user. The communication interface 162 may be coupled to an antenna, via which antenna wireless communications are transmitted and received over the short range wireless communication connection. It is also arranged to communicate with the CPU 152 via the communication bus.

The user interface display 164 is configured to display a battery level to the user and/or remaining time for aerosol generation device 100 usage and/or consumable remaining. In this embodiment, the user interface display 164 is an LED interface. In alternative embodiments, the user interface display 164 may be an LCD screen. The user interface display 164 may display the battery level to the user and/or remaining time for aerosol generation device 100 usage and/or consumable remaining when triggered by a user interaction. The user interaction may be interaction of the closure 106 and moving the closure 106 into any one of its positions.

The three positions of the closure 106 provide the ability for the closure 106 to trigger or provide multiple functions by using the one structural or interface element where the closure 106 is the one structure or interface element. This enhances the user experience and improves usability. In this example, the three positions of the closure 106 provide the following states or operating modes for the aerosol generation device 100 to function in:

"off" or "hibernate";

"standby" or "load"; and

"activation", "active", "use" or "aerosolise".

In particular, when the closure 106 is in the first position or moves into the first position, the aerosol generation device 100 will change to function in the "off" or "hibernate" mode. In particular when the closure 106 is in the second position or moves into the second positon, the aerosol generation device 100 will change to function in the "standby" or "load" mode. In particular when the closure 106 is in the third position or moves into the third position, the aerosol generation device 100 will change to function in the "activation", "active", "use" or "aerosolise" mode. Preferably, the aerosol generation device 100 will move into the "activation", "active", "use" or "aerosolise" mode even if the closure 106 is only briefly or temporarily in the third position. The "activation", "active", "use" or "aerosolise" mode may include heating the heating chamber 114, so as to aerosolise parts of the consumable.

A person skilled in the art will appreciate that other states may be possible for the aerosol generation device 100 to function in. For example, one state may provide temperature adjustment, or may provide an indication of amount of consumable left, or aerosolising time left, or provide an indication of a battery level, or lock or unlock a parental lock.

In the present embodiment, when in the off mode, the aerosol generation device 100 runs in a low power or no power mode. In this mode, the only function that is working is the detector module 160 and detector detecting when the closure 106 moves to or is in different positions. When in the standby mode, the aerosol generation device 100 is configured to display to the user the current battery level using the user interface display 164. The aerosol generation device 100 may also go into the off mode after a determined period of time.

To go into the activation mode, the closure 106 need not stay in the third position for the duration of the activation period. In the present embodiment, the user moves the closure 106 into the third position only briefly, the detector module 160 detects the movement or position of the closure 106 and moves the aerosol generation device 100 into the activation mode for a period of time, until the consumable is consumed (for example no further desirable aerosolisation is possible), or until the user removes the consumable. The activation mode is entered when the detector module 160 receives signals from the detector in any one or more of these following cases:

- the closure 106 moves into the third position from the second position,
- the closure 106 moves into the second position from the third position,
- the closure 106 moves into the third position from the first position,
- the closure 106 moves into the first position from the third position,
- the closure 106 is in the third position,
- the closure 106 is in the third position for greater than a threshold amount of time, or the closure 106 is in the third position for greater than a threshold amount of time and less than a further threshold amount of time.

With reference to FIG. 1E, the preferable detector is shown. In this preferable embodiment, the detector comprises a Hall effect sensor as the sensor 110. The detector also comprises a tactile switch as the further sensor 800.

Figure 2:
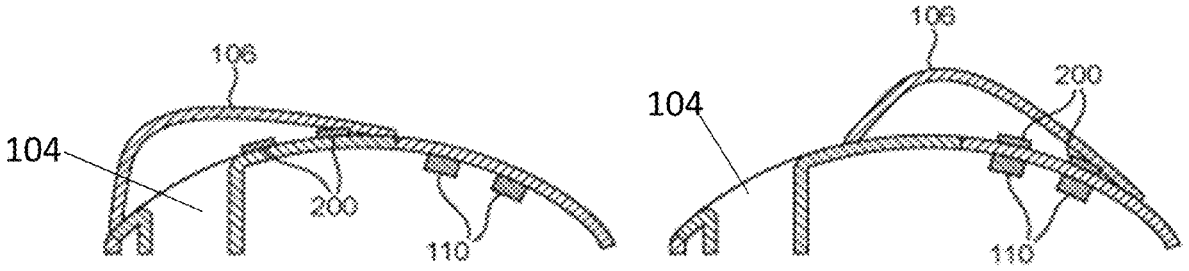
FIG. 2 is a schematic cross-sectional view of a closure and assembly according to a second embodiment of the disclosure, with the closure in a first and a second position.

In this preferred embodiment, a combination of the embodiment as described with reference to FIG. 2 is used with the embodiment described with reference to FIGS. 8A and 8B. In particular, a Hall effect sensor is used to determine movement of the closure 106 between the first and second positions or determine whether the closure 106 is in the first or second position. The Hall effect sensor is described in greater depth in the second embodiment with reference to the FIG. 2. In particular, the tactile switch 800 is used to determine movement of the closure 106 between the second and third positions or determine whether the closure 106 is in the second or third position or simply whether the closure 106 is in the third position or not. The tactile switch 800 is described in greater depth below in relation the eighth embodiment, with reference to FIGS. 8A and 8B.

Second Embodiment

With reference to FIG. 2, according to a second embodiment, the sensor 110 is at least one or more magnetic sensor(s). The aerosol generation device 100 of the second embodiment is identical to the aerosol generation device 100 of the first embodiment described with reference to FIGS. 1A to 1E, except where explained below, and the same reference numerals are used to refer to similar features. Preferably, the magnetic sensor(s) is/are a Hall effect sensor 110. The sensing element comprises at least one magnetic element(s) 200.

In this embodiment, the magnetic element(s) 200 are two magnets 200 and two Hall effect sensors 110 are used.

When the closure 106 is in the first position, the magnetic element(s) 200 are positioned far away from the Hall effect sensors 110. When the closure 106 is in the second position, the magnetic element(s) 200 are positioned closer to the Hall effect sensors 110. The Hall effect sensors 110 detect the proximity of the magnetic element(s) 200 and provide a signal indicative of the position of the closure 106. The distance of the magnetic element(s) 200 from the Hall effect sensor 110 is sensed by the Hall effect sensor 110. The Hall effect sensors 110 are configured to provide a signal indicative of the position of the closure 106. The Hall effect sensors 110 provide a signal indicative of the closure 106 being in the second position when both of the magnetic element(s) 200 are positioned above over the two Hall effect sensors 110.

In an alternative embodiment, the Hall effect sensors 110 are configured to detect the closure 106 in the third position. When moving into the third position, the magnetic element (s) 200 move closer to the Hall effect sensor 110 than when they are in the second position or the first position. The closer proximity is used to detect the third position.

In a further alternative embodiment, the closure 106 comprises at least two magnetic elements 200. There are also at least two Hall effect sensors 110 in the casing 102. The position of the closure 106 is determined by the number of magnetic elements 200 that align with the Hall effect sensors 110. In this alternative embodiment, when the closure 106 is in the first position, none of the at least two magnetic elements 200 align with the Hall effect sensors 110. In the second position, one of the at least two magnetic elements 200 aligns with the at least two Hall effect sensors 110. In the third position, at least two of the at least two magnetic elements 200 align with at least two of the at least two Hall effect sensors 110. A person skilled in the art will appreciate that other configurations are possible where, for example, in the first position, two of the magnetic elements 200 align with the Hall effect sensors 110 and in the third position none of the magnetic elements 200 align with the Hall effect sensors 110.

Two magnetic elements 200 and two Hall effect sensors 110 are used to provide redundancy and better error detection if one of the magnets were to be moved or the Hall effect sensor 110 breaks in some way. In an alternative embodiment, one magnet 200 and one Hall effect sensor 110 is used.

In an alternative embodiment, the closure 106 comprises at least two magnetic elements 200 placed transversally to the direction of movement of the closure 106 and equidistant along the closure 106. Correspondingly at least two Hall effect sensors 110 are located in the casing 102. The at least two Hall effect sensors 110 are also located transverse to the movement of the closure 106. This way, when a user moves the closure 106 from the first to the second position, at least two magnetic elements 200 will approach the at least two Hall effect sensors 110 at the same time. This reduces any non-desired early triggering or miss-triggering of the Hall effect sensors 110 which may result in inaccurate recordable of the position of the closure 106.

A person skilled in the art will appreciate that different numbers of magnetic element(s) 200 and Hall effect sensors may be used to balance accuracy about the position or status on the first, second, third, or more positions against design complexity and cost.

While this embodiment is described with the magnetic elements 200 position in the closure 106, a person skilled in the art will appreciate that the magnetic elements 200 can be placed in the casing 102 and the sensor 110 in the closure 106 in an alternative embodiment.

In an alternative embodiment, Reed switches are used instead of Hall effect sensor(s). The Reed switches provide a similar ability of the Hall effect sensor(s) in that they can detect magnetic fields however are limited to on/off signals or detection.

Third Embodiment

Figure 3:
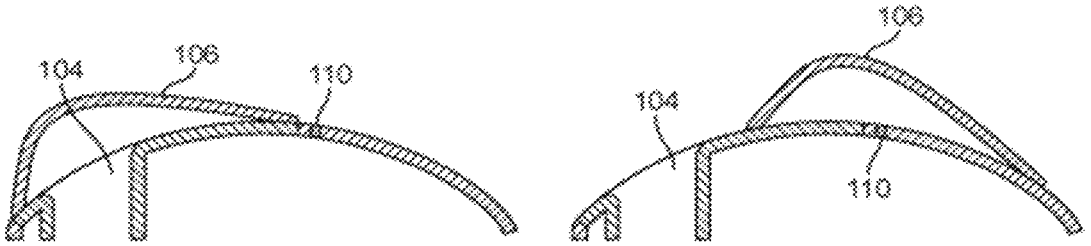
FIG. 3 is a schematic cross-sectional view of a closure and assembly according to a third embodiment of the disclosure, with the closure in a first and a second position.

With reference to FIG. 3, according to a third embodiment, the sensor 110 is a photodetector or light sensor. The aerosol generation device 100 of the third embodiment is identical to the aerosol generation device 100 of the first embodiment described with reference to FIGS. 1A to 1E, except where explained below, and the same reference numerals are used to refer to similar features. In this embodiment, the photodetector is a photodiode. Alternatively, the photodetector is any one of more of the following: a light dependent resistor (LDR), a phototransistor, a solaristor, a photovoltaic cell, and/or a bolometer. A person skilled in the art will appreciate that other photodetectors may be used.

The photodetector 110 is arranged to receive ambient light from the outside environment when the closure 106 is in a first position. When the closure 106 is in a second position, the closure 106 blocks ambient light from reaching the photodetector 110. The closure 106 blocks ambient light reaching the photodetector by covering the photodetector with the closure 106 itself.

The closure 106 acts as the sensing element in this embodiment.

In an alternative embodiment, when the closure 106 is in the third position, the closure 106 also blocks ambient light from reaching the photodetector.

In this embodiment, the photodetector is located on the edge of the first end of the casing 102. In an alternative embodiment, the photodetector 110 is located within the casing 102 and a light pipe is configured to transmit ambient light from outside the casing 102 to the photodetector. In further alternative embodiments, the casing 102 comprises a hole or translucent window or transparent window or the casing 102 is translucent in at least a region. Further, the closure 106 is opaque. The photodetector is located within the casing 102 and arranged to receive light through the hole or window in the casing 102 or through the transparent casing 102.

Fourth Embodiment

Figure 4:
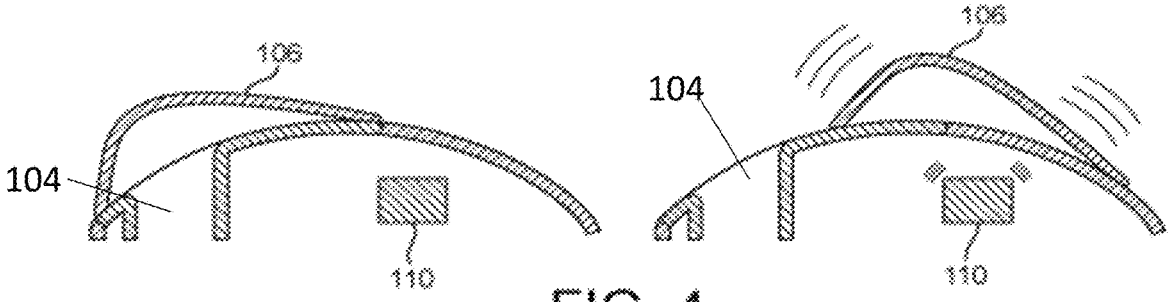
FIG. 4 is a schematic cross-sectional view of a closure and assembly according to a fourth embodiment of the disclosure, with the closure in a first and a second position.

With reference to FIG. 4, according to a fourth embodiment, the sensor 110 is an acoustic sensor. The aerosol generation device 100 of the fourth embodiment is identical to the aerosol generation device 100 of the first embodiment described with reference to FIGS. 1A to 1E, except where explained below, and the same reference numerals are used to refer to similar features. In this embodiment, the closure 106 or casing 102 comprises an acoustic element arranged to emit a sound. The acoustic element is the sensing element The acoustic element is arranged to emit a sound as it moves from the first to the second position, or when in the second position. In this embodiment, the acoustic element is a protrusion that, when the closure 106 is moved into the second position, the protrusion interacts with a corresponding notch on the casing 102. The interaction between the protrusion moving into the notch causes the closure 106 or casing 102 to emit a sound.

In an alternative embodiment, the acoustic element is a spring loaded device. When moving the closure 106, the spring is configured to compress or extend. Once the closure 106 has moved into the first or second position, the spring is configured to release to its original state. The release of the spring causes the aerosol generation device 100 or components of the aerosol generation device 100 to emit a sound.

In an alternative embodiment in addition to the sound emission between the first and second positions or in the second position, when in the closure 106 is in the third position or as the closure 106 moves into the third position, the acoustic element produces another noise for the acoustic sensor to detect.

In a further alternative embodiment, the acoustic element is further configured to provide acoustic or haptic feedback to the user such that the user knows when the closure 106 is sensed moving from the first to second positions, or second to third positions or has moved into each position.

The acoustic element may be used in combination with other embodiments to provide acoustic or haptic feedback to the user.

Fifth Embodiment

Figure 5:
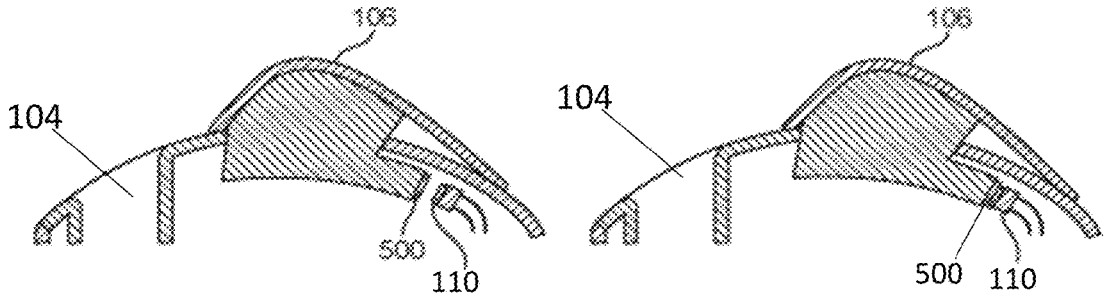
FIG. 5 is a schematic cross-sectional view of a closure and assembly according to a fifth embodiment of the disclosure, with the closure in a position between the first and a second and in the second position.

With reference to FIG. 5, according to a fifth embodiment, the sensor 110 is a light responsive proximity sensor. Preferably, the detector is an infra-red sensor. The aerosol generation device 100 of the fifth embodiment is identical to the aerosol generation device 100 of the first embodiment described with reference to FIGS. 1A to 1E, except where explained below, and the same reference numerals are used to refer to similar features.

The left hand image of FIG. 5 shows the closure 106 in the process of moving from the first position to the second position. The right hand image of FIG. 5 shows the closure 106 in the second position.

In this embodiment, the sensing element is a light reflective element 500. Preferably, the light reflective surface is a mirror or other element which reflects strongly in a relevant part of the spectrum as set out below.

The light responsive proximity sensor uses different distances to determine the position of the closure 106. When in the first position, the closure 106 is further away from the sensor 110 than when the closure 106 is in the second position. Alternatively, when in the first position the closure 106 further away from the sensing element than when the closure 106 is in the second position.

The light responsive proximity sensor 110 comprises a transmitter and a receiver. The light responsive proximity sensor 110 is configured to transmit light towards the light reflective element 500 and receive the light at the receiver. By directly measuring the time of flight of the light, the distance the light has travelled can be measured. Alternatively, indirect time of flight measure is used to determine the distance the light has travelled. Alternatively, the distance is calculated by measuring the intensity of light where the lower the intensity, the further the light has travelled. Preferably, the light is infra-red light, and the light reflective element 500 is configured to reflect strongly in the infra-red part of the spectrum.

In an alternative embodiment, when the closure 106 is in the third position, the distance measured is different from the distance measured when the closure 106 is in the first position and the second position. In the third position, the closure 106 is closer to the light responsive proximity sensor 110 than compared with the first and second positions.

In an alternative embodiment, the presence or lack of light being reflected is used to determine the position of the closure 106. For example, when the closure 106 is in the first position, the light is reflected back to the sensor 110 and when the closure 106 is in the second position, the light is not reflected back to the sensor. The opposite may also be used. The light may not be reflected back because the angle of the mirror 500 in the first position does not reflect the light directly towards the light responsive proximity sensor 110. Alternatively, the closure 106 may obscure the light path when in the first or second position.

In a further alternative embodiment, at least two light responsive proximity sensors 110 are used. The positions of the closure 106 may be inferred according to the truth table provided below about whether the light responsive proximity sensors 110 detect light or not. The table below is provided as an example only. The positions of the closure 106 may be based on different on/off sensor states depending on the arrangement of the closure 106 and sensor 110 arrangements. A person skilled in the art will appreciate that with 2 bits of information (where each bit represents the reception or not of light at each light responsive proximity sensor) at least three states (such as the three positions of the closure 106) can be represented.

| | Second Sensor | |
|---|---|---|
| First Sensor | Light Detected | No Light Detected |
| Light Detected | First Position | Second Position |
| No Light Detected | N/A | Third Position |

Preferably, the light transmitter modulates the light it transmits at a given frequency. The receiver is able to filter out all signals received except for the frequency that the transmitter has modulated the light. This modulation scheme provides improved interference rejection.

Preferably, the closure 106 comprises the sensing element and the light responsive proximity sensor 110 is in the casing 102.

Sixth Embodiment

Figure 6:
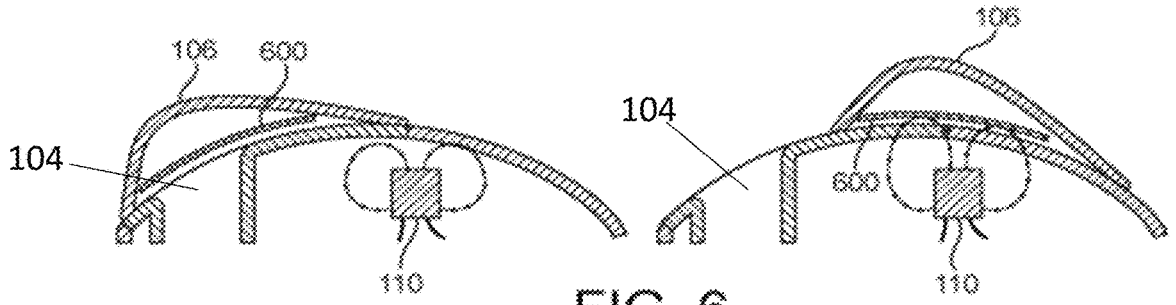
FIG. 6 is a schematic cross-sectional view of a closure and assembly according to a sixth embodiment of the disclosure, with the closure in a first and a second position.

With reference to FIG. 6, according to a sixth embodiment, the sensor 110 is an inductive sensor. The aerosol generation device 100 of the sixth embodiment is identical to the aerosol generation device 100 of the first embodiment described with reference to FIGS. 1A to 1E, except where explained below, and the same reference numerals are used to refer to similar features.

In this embodiment, the sensing element is a conductive element 600. In particular, the conductive element 600 is a metal strip.

The inductive sensor is configured to sense the proximity of the conductive element 600. When the closure 106 is in the first position, the conductive element 600 positioned further away from the inductive sensor 110 than when the closure 106 is in the second position. When the closure 106 is in the first position, the inductive sensor cannot sense the conductive element 600 or sense the conductive element 600 less. The fact the inductive sensor 110 cannot sense the conductive element 600 or sense the conductive element 600 less is used to determine that the closure 106 is in the first position.

In an alternative embodiment, the inductive sensor is located closer to the aperture 104 than in the previous embodiment. This way, the conductive element 600 is positioned further away from the inductive sensor when the closure 106 is in the second position than when it is in the first position.

In an alternative embodiment, when the closure 106 is in the third position, the distance measured by the inductive sensor is different from the distance measured in the first position and the second position. In the third position, the sensing element is closer to the inductive sensor than compared with the second and first positions.

Seventh Embodiment

Figure 7:
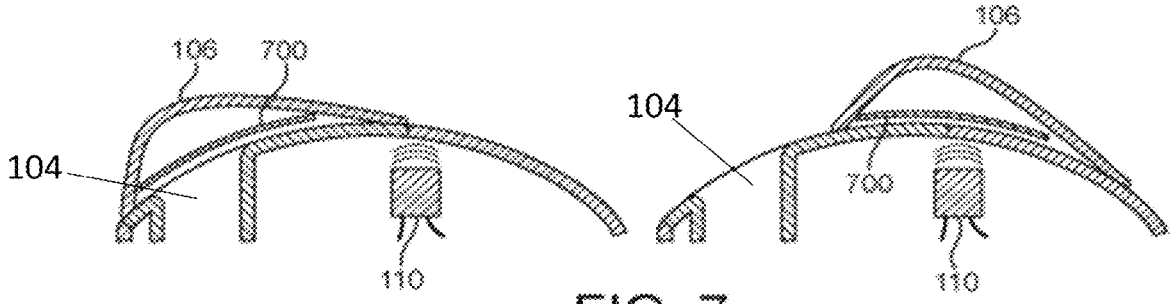
FIG. 7 is a schematic cross-sectional view of a closure and assembly according to a seventh embodiment of the disclosure, with the closure in a first and a second position.

With reference to FIG. 7, according to a seventh embodiment, the sensor 110 is an ultrasound sensor. The aerosol generation device 100 of the seventh embodiment is identical to the aerosol generation device 100 of the first embodiment described with reference to FIGS. 1A to 1E, except where explained below, and the same reference numerals are used to refer to similar features.

In this embodiment, the sensing element comprises an acoustically reflective element 700.

In this embodiment, the reception of acoustic waves (or not) is used to determine whether the closure 106 is in the first or second position. When the closure 106 is in the second position, the ultrasound sensor 110 transmits ultrasonic waves which are reflected off the acoustically reflective element 700 and received at the ultrasonic sensor. When the closure 106 is in the first position, the ultrasound sensor 110 transmits ultrasonic waves however they are not received back at the ultrasound sensor 110.

In an alternative embodiment, the acoustic sensor 110 is oriented towards the first position of the closure 106. In this way, ultrasound sensor 110 transmits ultrasonic waves which are reflected off the acoustically reflective element 700 and received at the ultrasonic sensor 110 when the closure 106 is in the first position. Similarly, when the closure 106 is in the second position, the ultrasonic waves are not received at the acoustic sensor 110.

In an alternative embodiment, when the closure 106 is in the third position, the acoustically reflective element 700, is in line with, and closer to, the ultrasound sensor 110. The ultrasound sensor 110 is configured to determine the difference between the second and third position by measuring the distance of the acoustically reflective element 700 and the ultrasound sensor, for example by the time elapsed between emission and reception of a signal.

Eighth Embodiment

Figure 8A:
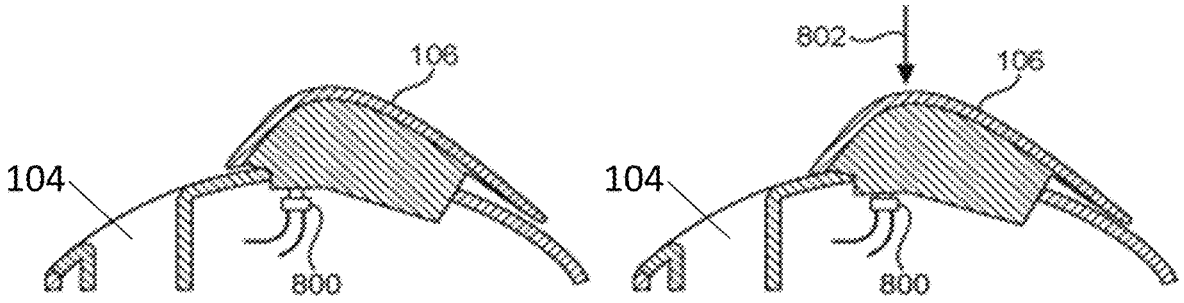
FIG. 8A is a schematic cross-sectional view of a closure and assembly according to an eighth embodiment of the disclosure, with the closure in a second and a third position.

With reference to FIG. 8A, according to an eighth embodiment, the further sensor 800 is a tactile switch. A tactile switch is sometimes called a "push button switch". The aerosol generation device 100 of the eighth embodiment is identical to the aerosol generation device 100 of the first embodiment described with reference to FIGS. 1A to 1E, except where explained below, and the same reference numerals are used to refer to similar features.

The further sensor 800 is a tactile switch and the closure 106 comprises a tactile switch engagement member. The tactile switch interface member is configured to engage with the tactile switch 800. The tactile switch 800 being depressed signifies that the closure 106 is in the third position. The tactile switch 800 is depressed when the closure 106 is pressed down by the user. The user presses the closure 106 down in the direction of the arrow 802. The aerosol generation device 100 is configured to receive signals indicative of the tactile switch 800 being depressed.

In the present embodiment, the tactile switch 800 is located in the casing 102. Alternatively, the tactile switch is located in the closure 106.

Figure 8B:
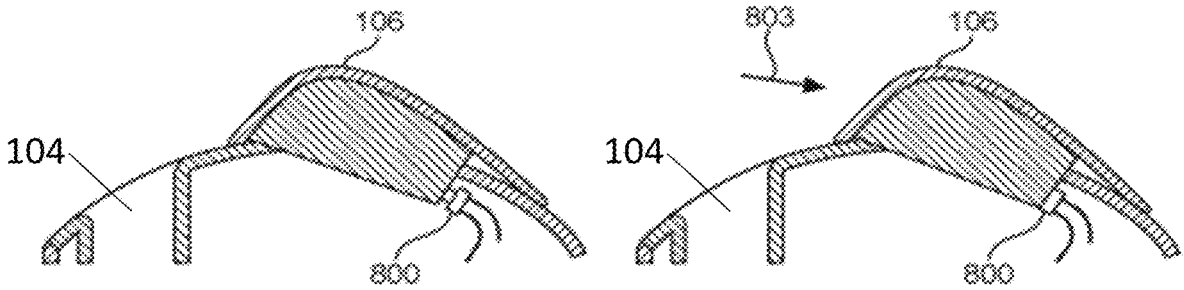
FIG. 8B is a schematic cross-sectional view of a closure and assembly according to the eight embodiment of the disclosure, with the closure in a second and a third position.
Figure 16:
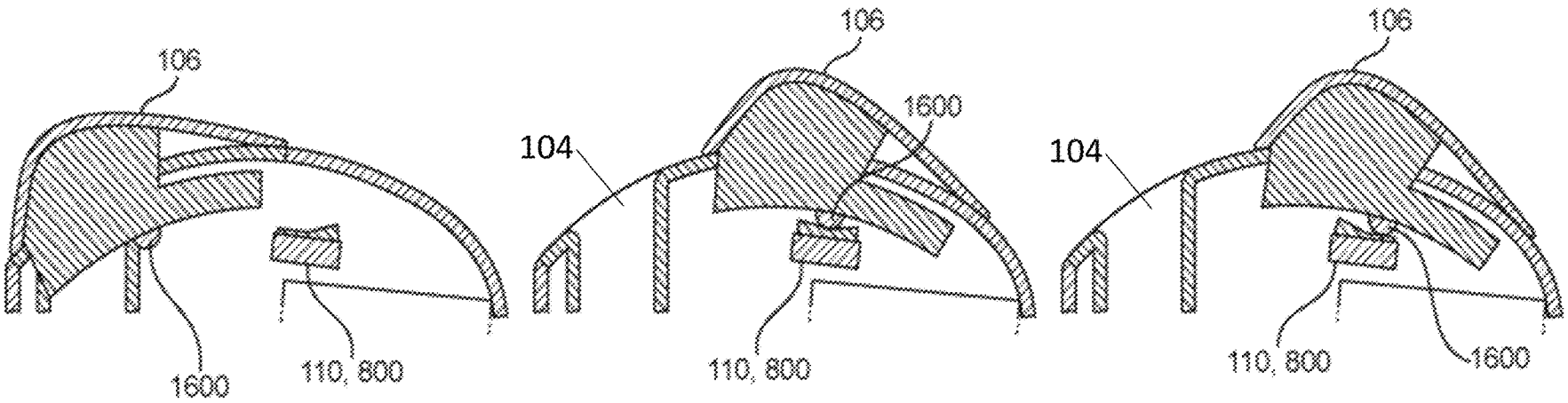
FIG. 16 is a schematic cross-sectional view of a closure and assembly according to a sixteenth embodiment of the disclosure, with the closure in a second and a third position.

With reference to FIG. 8B, an alternative embodiment to the eighth embodiment is shown. The further sensor 800 is again a tactile switch. This alternative embodiment shows the tactile switch oriented differently, in particular abutting against an end transversal surface of the closure, for when the third position of the closure 106 is a translation along the direction of the arrow 803. As shown in FIG. 16, the closure 106 depresses the tactile switch when it is moved into the third position.

Ninth Embodiment

Figure 9:
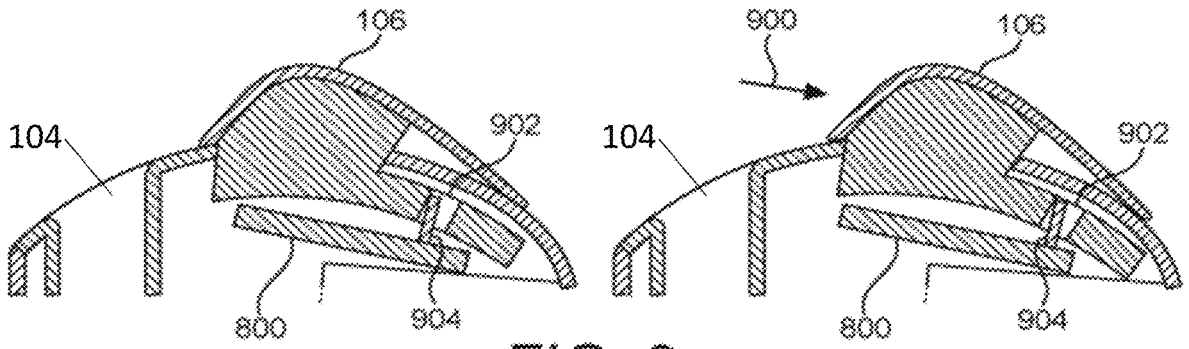
FIG. 9 is a schematic cross-sectional view of a closure and assembly according to a ninth embodiment of the disclosure, with the closure in a second and a third position.

With reference to FIG. 9, according to a ninth embodiment, the further sensor 800 is a slider switch. The closure 106 comprises a switch receiving member 902. The slider switch comprises a sliding member 904. The aerosol generation device 100 of the ninth embodiment is identical to the aerosol generation device 100 of the first or eighth embodiment described with reference to FIGS. 1A to 1E or 8, except where explained below, and the same reference numerals are used to refer to similar features.

A user moves the closure 106 into the third position by applying a force along the arrow 900. This third position of the closure 106 is a translation of the closure 106 further along the path from the first and second positions of the closure 106. The detector module 160 receives signals from the slide switch indicative of the position of the closure 106

The switch receiving member 902 is configured to receive the slider switch sliding member 904. When the closure 106 moves, so too does the switch receiving member 902. The switch receiving member 902 moves the sliding member 904. The slider switch is configured to determine the position and/or movement of the closure 106. The aerosol generation device 100 is configured to receive signals indicative of the sliding member's 904 position and therefore the position of the closure 106.

In another embodiment, the sliding switch is also used for detecting when the closure 106 is in the first position. The sliding member 904 is further configured to slide further left position (not shown) when the closure 106 is in the first position. In this embodiment, the slider acts as the sensor 110 and there is no further detector 800.

The slider switch provides a number of switch positions for the detector module 160 to receive signals indicative of. The signals indicative of switch positions are indicative of the closure 106 positions. Alternatively, the slider switch is a variable resistor and the detector, the sensor 110 or detector module 160 generates signals indicative of the position of the closure 106 based on the resistance measure across the slider switch.

Tenth Embodiment

Figure 10:
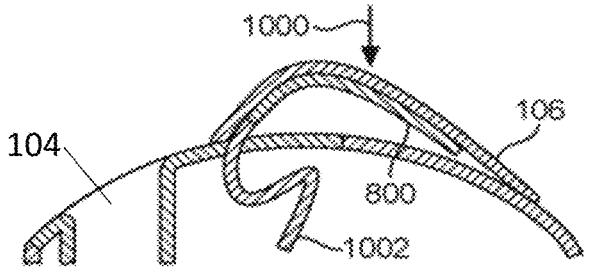
FIG. 10 is a schematic cross-sectional view of a closure and assembly according to a tenth embodiment of the disclosure, with the closure in a second position.

With reference to FIG. 10, according to a tenth embodiment, the further sensor 800 is a capacitive touch sensor. The capacitive touch sensor comprises a flexible cable 1002. The flexible cable 1002 is configured to allow the closure 106 to be in the first position without damaging the cable. The aerosol generation device 100 of the tenth embodiment is identical to the aerosol generation device 100 of the first or eighth embodiment described with reference to FIGS. 1A to 1E or 8, except where explained below, and the same reference numerals are used to refer to similar features.

In this embodiment, the user depresses the closure 106 in the direction shown by the arrow 1000. The capacitive touch sensor is configured to detect when a user touches it.

The aerosol generation device 100 is configured to detect when the closure 106 is in the third position by determining when the user touches the capacitive touch sensor while the closure 106 is in the second position.

In an alternative embodiment, the capacitive touch sensor has two touch sensitive parts. The first touch sensitive part is positioned such that in use and when the closure 106 is moving from the first position to the second position, the user touches it. This first touch sensitive part is on the edge of the closure 106. In particular, the edge the user touches to slide the closure 106. The second touch sensitive part is positioned such that in use and when moving the closure 106 is moving from the second position to the third position, the user touches it. The second touch sensitive part is the top of the closure 106. In this embodiment, the capacitive touch sensor behaves as the sensor 110 and the further sensor 800 with the two touch sensitive part.

Eleventh Embodiment

Figure 11:
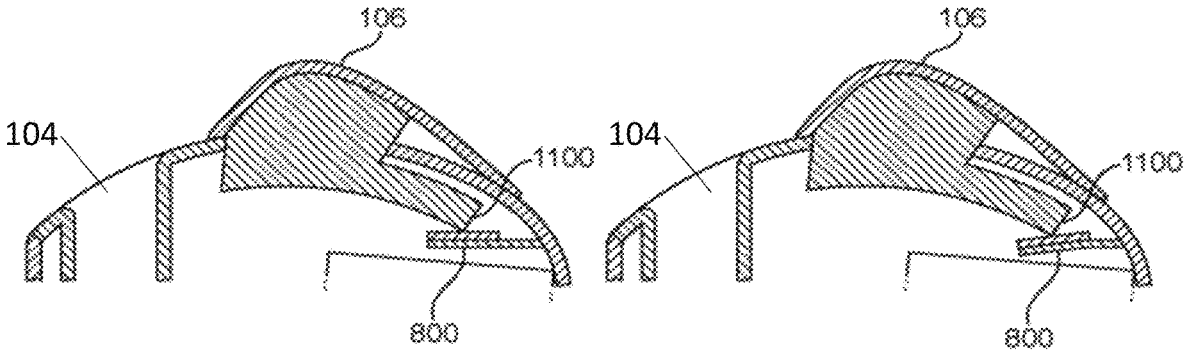
FIG. 11 is a schematic cross-sectional view of a closure and assembly according to an eleventh embodiment of the disclosure, with the closure in a second and a third position.

In an eleventh embodiment, with reference to FIG. 11, the further sensor 800 is a force sensitive resistor. The closure 106 comprises a sensor interface member 1100. The force sensitive resistor is within the case 102. The aerosol generation device 100 of the eleventh embodiment is identical to the aerosol generation device 100 of the first or eighth embodiment described with reference to FIGS. 1A to 1E or 8, except where explained below, and the same reference numerals are used to refer to similar features.

The sensor interface member 1100 of the closure 106 interfaces with the force sensitive resistor when a user moves the closure 106 into the third position. The force sensitive resistor provides a signal indicative of the force being applied to it. In this case, when the sensor interface member 1100 interfaces with the force sensitive resistor, the resistance of the force sensitive resistor increases. The resistance is measured and the aerosol generation device 100 uses that information to determine the position of the closure 106.

Twelfth Embodiment

Figure 12:
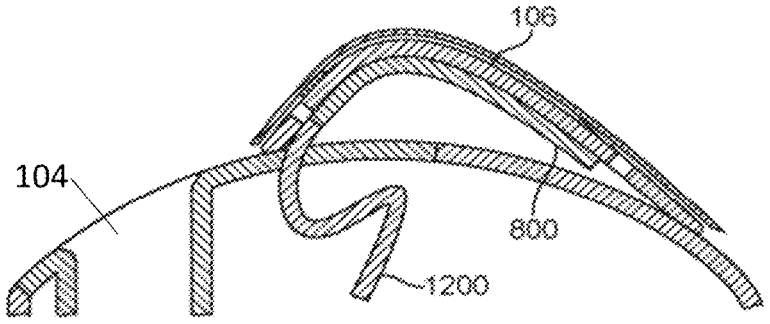
FIG. 12 is a schematic cross-sectional view of a closure and assembly according to a twelfth embodiment of the disclosure, with the closure in a second position.

In a twelfth embodiment, with reference to FIG. 12, the further sensor 800 is a force sensitive resistor. The closure 106 comprises the force sensitive resistor. The aerosol generation device 100 of the twelfth embodiment is identical to the aerosol generation device 100 of the first or eighth embodiment described with reference to FIGS. 1A to 1E or 8, except where explained below, and the same reference numerals are used to refer to similar features.

The force sensitive resistor of this embodiment functions similarly to the force sensitive resistor of the embodiment as described with reference to FIG. 11 in that the aerosol generation device 100 uses the resistance of the force sensitive resistor to determine the position of the closure 106. The resistance of the force sensitive resistor is a result of the pressure or force applied to it.

The force sensitive resistor is connected to the casing 102 via a connecting member 1200. The connection member 1200 is a flexible member. The connection member 1200 is made from a deformably resilient material. The flexibility of the connection member 1200 allows the closure 106 to be in the first position without damaging it or the further sensor 800.

The force applied to the force sensitive resistor comes from the user pressing down vertically or perpendicularly on the closure 106. Alternatively, the force applied to the force sensitive resistor comes from the user to the side of closure 106 further along the direction of arrow A of FIGS. 1A and 1B.

Thirteenth Embodiment

Figure 13:
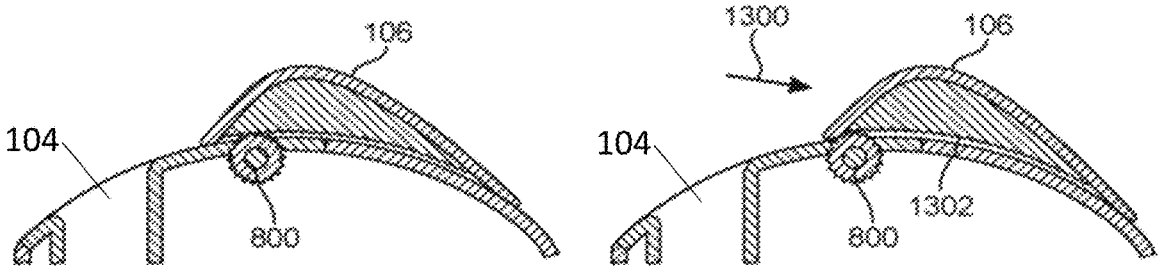
FIG. 13 is a schematic cross-sectional view of a closure and assembly according to a thirteenth embodiment of the disclosure, with the closure in a second and a third position.

In a thirteenth embodiment, with reference to FIG. 13, the further sensor 800 is a rotary encoder. The rotary encoder is configured to interface with the toothed interface 1302 internal to the closure 106. The aerosol generation device 100 of the thirteenth embodiment is identical to the aerosol generation device 100 of the first or eighth embodiment described with reference to FIGS. 1A to 1E or 8, except where explained below, and the same reference numerals are used to refer to similar features.

The user moves the closure 106 from the second position to the third positon by pushing the closure 106 along the direction the arrow 1300 is pointing. The toothed interface 1302 engages with the rotary encoder such that the rotary encoder rotates when the closure 106 moves. The rotary encoder counts the amount of rotation which translates to the amount and direction of linear or substantially linear movement of the closure 106. The aerosol generation device 100 uses the rotation information to determine which position the closure 106 is in.

In a further embodiment, the rotary encoder is also configured to detect when the closure 106 is in the first position (not shown in FIG. 13). By counting the number of rotations the rotary encoder goes through, the position of the closure 106 can be determined. In this embodiment, the rotary encoder behaves as the sensor 110 and the further sensor 800 isn't used. Or alternatively described, the rotary encoder behaves as both the sensor 110 and the further sensor 800.

Fourteenth Embodiment

Figure 14:
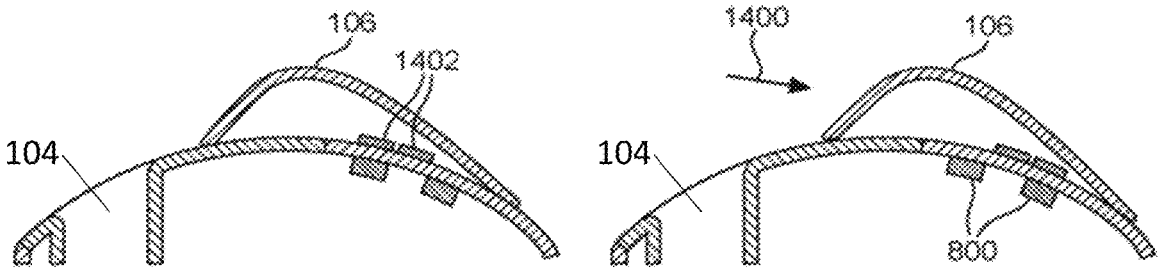
FIG. 14 is a schematic cross-sectional view of a closure and assembly according to a fourteenth embodiment of the disclosure, with the closure in a second and a third position.

In a fourteenth embodiment, with reference to FIG. 14, the further sensor 800 is two Hall effect sensors. The aerosol generation device 100 comprises at least 1 magnet(s) 1402. The aerosol generation device 100 of the fourteenth embodiment is identical to the aerosol generation device 100 of the first or eighth embodiment described with reference to FIGS. 1A to 1E or 8, except where explained below, and the same reference numerals are used to refer to similar features.

The user moves the closure 106 from the second position to the third position along the direction the arrow 1400 is pointing. Moving the closure 106 from the second position to the third position aligns the magnet(s) 1402 with the hall sensor(s) in different positions. These different positions are used to determine the position the closure 106. In this embodiment, the Hall effect sensors sense that the magnet(s) 1402 magnets are in a particular orientation and/or position. The particular orientation and/or positon of the magnets relative to the Hall effect sensors relate to the position of the closure 106. The position and/or orientation of the magnets is detected based on whether the Hall effect sensors detect a magnetic field or not. Alternatively, position and/or orientation of the magnets is detected based on whether the amount and direction of magnetic field that the Hall effect sensors detect.

With reference to the example shown in FIG. 14, when the closure 106 is in the second position, the first Hall sensor detects a magnetic field and the second Hall sensor doesn't detect a magnetic field (or alternatively, detects only a weak magnetic field). When the closure 106 is in the third position, the first Hall effect sensor doesn't detect a magnetic field (or alternatively, detects only a weak magnetic field) and the second Hall effect sensor does detect a magnetic field.

In an alternative embodiment, there is only one magnet and one Hall effect sensor. In this alternative embodiment, the strength of the magnetic field is used to determine the position of the closure 106. When the closure 106 is in the second position, the Hall effect sensor detects the magnetic field either strongly or weakly. When the closure 106 is in the third position, the Hall effect sensor detects the other of strongly or weakly respectively to the second position of the closure 106.

A person skilled in the art will appreciate that this embodiment may be used in combination with an embodiment as described with reference to FIG. 2. In this case, the same Hall effect sensor(s) is used as both the sensor 110 and further sensor 800.

In an alternative embodiment, the reed switches are used instead of Hall effect sensor(s). The reed switches provide a similar ability of the Hall effect sensor(s) in that they can detect magnetic fields however are limited to on/off.

Fifteenth Embodiment

Figure 15:
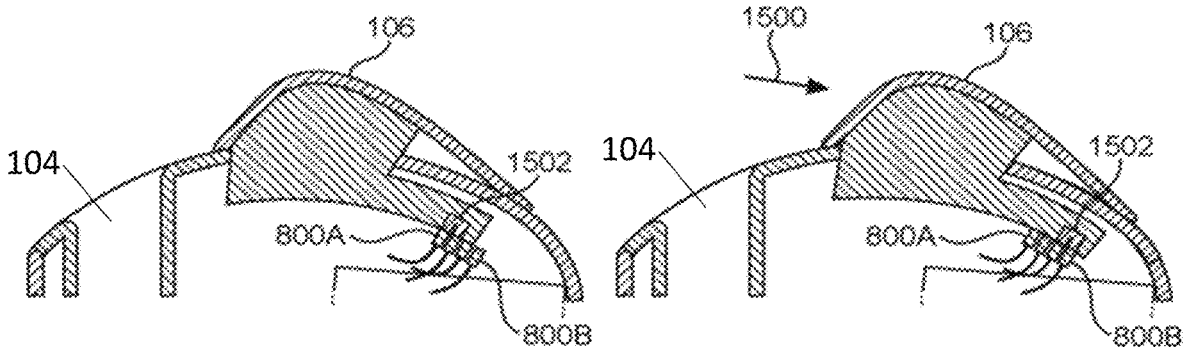
FIG. 15 is a schematic cross-sectional view of a closure and assembly according to a fifteenth embodiment of the disclosure, with the closure in a second and a third position.

In a fifteenth embodiment, with reference to FIG. 15, the further sensor 800 comprises two electrical continuity detectors 800A, 800B. The aerosol generation device 100 of the fifteenth embodiment is identical to the aerosol generation device 100 of the first or eighth embodiment described with reference to FIGS. 1A to 1E or 8, except where explained below, and the same reference numerals are used to refer to similar features.

The further sensor 800 is configured to detect whether the first or second continuity detectors detect continuity or not. The two electrical continuity detectors 800A, 800B detect continuity when the continuity device 1502 connects with them and completes the circuit. The continuity device 1502 is a wire, PCB track, or other conductive material such as metal and in particular copper. The user moves the closure 106 from the second position to the third position along the direction the arrow 1500 is pointing. Moving the closure 106 from the second position to the third position aligns the electrical continuity detectors 800A, 800B with the continuity device 1502 in different positions.

When the closure 106 is in the second position, the first electrical continuity detector 800A detects continuity because the continuity device 1502 provides a return path. The second electrical continuity detector 800B does not detect electrical continuity. And respectively, when the closure 106 is in the third position, the first electrical continuity detector 800A does not detect continuity and the second electrical continuity detector 800B does detect electrical continuity.

Sixteenth Embodiment

In a sixteenth embodiment, with reference to FIG. 16, the sensor 110 is a rocker switch. The aerosol generation device 100 of the sixteenth embodiment is identical to the aerosol generation device 100 of the first or eighth embodiment described with reference to FIGS. 1A to 1F and FIGS. 8A and 8B, except where explained below, and the same reference numerals are used to refer to similar features.

In this embodiment as shown in FIG. 16, the rocker switch functions as both the sensor 110 and the further sensor 800. The rocker switch in this embodiment is a three position switch. One position of the rocker switch corresponds to each of the three positions of the closure 106.

In this example embodiment, the user moves the closure 106 between the first, second, and third positions, all of which are on substantially the same path and that the user translates closure 106 between the three positions.

The aerosol generation device 100 comprises a rocker switch interface member 1600. The rocker switch interface member 1600 is configured to interface with the rocker switch. When the closure 106 is moved between its three positions, the rocker switch interface member 1600 will interface with the rocker switch to move it through its three positions.

In an alternative embodiment, the rocker switch is only an activation detector 800 and is configured to detect movement of the closure 106 from the second position to the third position and vice-versa. Or the rocker switch is configured to detect the position of the closure 106 in the first/second position or the third position (as the rocker switch won't be able to determine whether it is in the first or second position). The rocker switch is in this example only a two position switch.

Seventeenth Embodiment

Figure 17A:
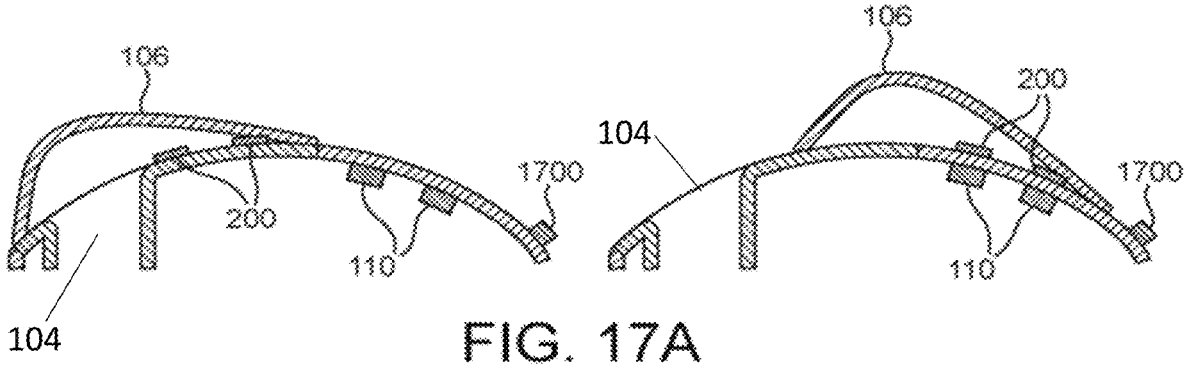
FIG. 17A is a schematic cross-sectional view of a closure and assembly according to a seventeenth embodiment of the disclosure, with the closure in a first, a second and a third position.
Figure 17B:
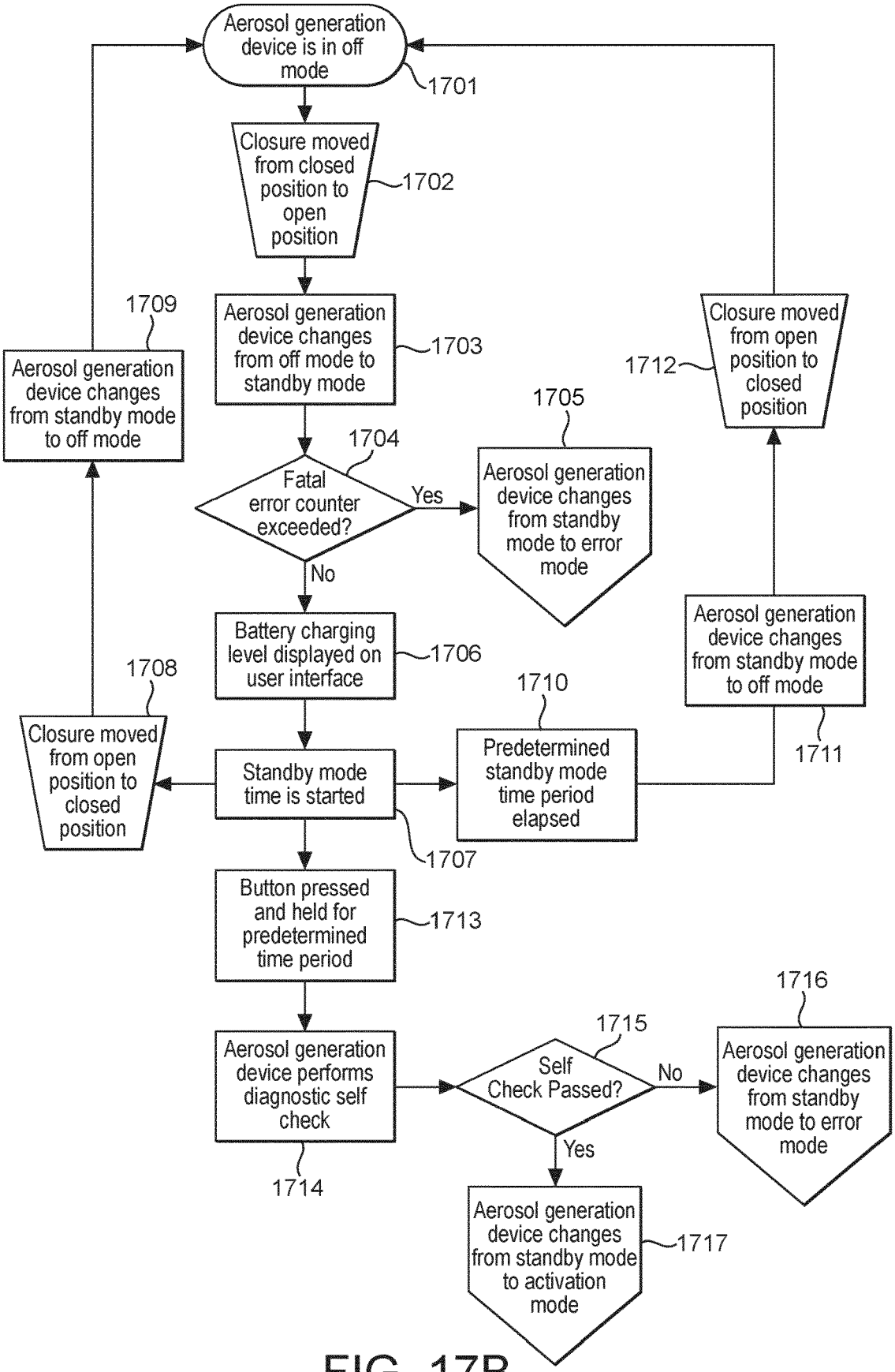
FIG. 17B is a flow chart illustrating operation of the aerosol generation device of the seventeenth embodiment, as controlled by movement of the closure and a button.

Referring to FIGS. 17A and 17B, in a seventeenth embodiment, the closure 106 has only two positions and the sensor 110 is a contactless sensor. The sensor 110 is used to determine the position of the closure 106. The aerosol generation device 100 of the seventeenth embodiment is identical to the aerosol generation device 100 of the first embodiment described with reference to FIGS. 1A to 1E, except where explained below, and the same reference numerals are used to refer to similar features.

In this embodiment, the contactless sensor is preferably a Hall sensor as described with reference to FIG. 2, although any of the contactless sensors described herein (ultrasound, inductance, light sensors, etc.) may also be used.

The aerosol generation device 100 comprises a further button 1700, for example unrelated to the sliding motion of the closure 106, to go into the activation mode. An example of this embodiment is illustrated in FIG. 17A in which the button 1700 is positioned at a location spaced apart from the closure 106. In this embodiment, both the closure 106 and the button 1700 are on the first end of the casing 102. The button 1700 is located on an outer surface of the aerosol generation device 100, so as to be accessible to a user. Specifically, the button 1700 is on the casing 102 of the aerosol generation device 100. In other embodiments, the closure 106 is on the first end of the casing 102 and the button 1700 is on a side wall of the casing, e.g. proximate or next to the display interface 112. The activation mode can only be entered when the closure 106 is in the second position, for example by the sensor 110 detecting the position of the closure 106 and allowing or forbidding activation based on the detected position.

Referring to FIG. 17B, movement of the closure 106 and actuation of the button 1700 cause the aerosol generation device to perform certain functions, and therefore the user to control at least some of the functions by causing the movement and the actuation. The flowchart of FIG. 17B outlines seventeen steps.

An initial state of the aerosol generation device 100 is an off mode 1701. In the off mode 1701, the closure 106 is in the first, or closed, position.

At step 1702, the user interacts with the aerosol generation device 100 to move the closure 106 from the first, or closed, position to the second, or open, position. The movement of the closure 106 from the first, or closed, position to the second, or open, position causes the CPU 152 to enter the aerosol generation device 100 into a standby mode, at step 1703.

With the aerosol generation device 100 in the standby mode, a fatal error counter is activated by the CPU 152, at 1704, and logic is applied depending on the count of fatal errors. This helps to protect the user from the aerosol generation device 100 if it were faulty.

If the fatal error counter is exceeded, then at step 1704 the CPU 152 changes the mode of the aerosol generation device 100 from the standby mode to an error mode, at step 1705.

If the fatal error count is not exceeded at step 1704, then the aerosol generation device 100 remains in the standby mode.

The aerosol generation device 100 is configured to carry out a battery level checking function at step 1706. The battery level checking function comprises the CPU 152 monitoring the charge level of the battery 118 and displaying the charge level of the battery 118 on the user interface display 164. In this embodiment, the user interface display 164 comprises an array of LEDs. A number of the LEDs in the array that illuminate is controlled to change in proportion to the battery charge level. This allows the user to check the charge level of the battery 118 before activating the aerosol generation device 100.

The battery level checking function may be disabled by the CPU 152 when the battery 118 is on charge. This may be when the battery 118 is connected to a charger adapted to charge the battery 118 and the battery 118 is not fully charged. The battery level checking function may be enabled when the battery 118 is fully charged.

At step 1707, a standby mode timer is started. This may occur after the battery charging level has been displayed at 1706.

If the user moves the closure 106 from the second, or open, position to the first, or closed, position, then, at 1708, then the standby mode timer is cancelled by the CPU 152. This user movement causes the CPU 152 to change the mode from standby mode to off mode, at step 1709, so that the operation of the aerosol generation device 100 returns to step 1701.

If the predetermined standby mode time period elapses without a user interacting with the aerosol generation device 100 then, at step 1710, then the CPU 152 changes the operation of the aerosol generation device 100 from the standby mode to the off mode, at step 1711. The predetermined standby mode time period may be determined by the manufacturer of the aerosol generation device 100 and may preferably last around one minute. However, alternative embodiments may have a different predetermined standby mode time period depending on the design requirements for the aerosol generation device 100. In order to return the aerosol generation device 100 to the off mode and the operational state illustrated by step 1701, the user must move the closure 106 from the second, or open, position to the first, or closed, position, at 1712. The aerosol generation device 100 then returns to step 1701.

If, at step 1713, the button 1700 is pressed and held for a predetermined time period within the predetermined standby mode time period then the aerosol generation device 100 proceeds to step 1714. In this embodiment, the aerosol generation device 100 stores a threshold time period and the button 1700 must be held for a period of time greater than the threshold time period in order to initiate entry of the aerosol generation device 100 into an activation mode. However, in other embodiments, there is no such threshold time period, and the button 1700 must simply be actuated with the aerosol generation device 100 in the standby mode in order to initiate entry of the aerosol generation device 100 into the activation mode. In yet another embodiment, either movement of the closure 106 to the second position or actuation of the button 100 enters the aerosol generation device 100 into the standby mode at step 1702, then the other of movement of the closure 106 to the second position and actuation of the button 100 initiates entry of the aerosol generation device 100 into the activation mode at step 1713.

The predetermined time period, at step 1713, may be determined by the manufacturer of the aerosol generation device 100 and may preferably last around 1 second. However, alternative embodiments may have a different predetermined standby mode time period depending on the design requirements for the aerosol generation device 100. The main requirement for the predetermined time period is that it is long enough so that if the user pressed the button 1700 by accident it would not be for long enough to activate the aerosol generation device 100.

At 1714 the CPU 152 performs a diagnostic self-check. For example, the aersol generation device tests the state of the battery 118 and/or the temperature of one or more components of the aerosol generation device 100 and the resistance of an electrical circuit through a heater associated with the heating chamber 114.

At step 1715, the CPU 152 confirms whether the self-check has been passed. If the self-check is failed, then the CPU 152 changes the mode from standby mode to error mode, at step 1716. If the self-check is passed, then the CPU 152 changes the mode from the standby mode to the activation mode, at step 1717. In the activation mode, the CPU 152 activates the heating module 158 and the user is able to use the aerosol generation device 100.

Eighteenth Embodiment

Figure 18:
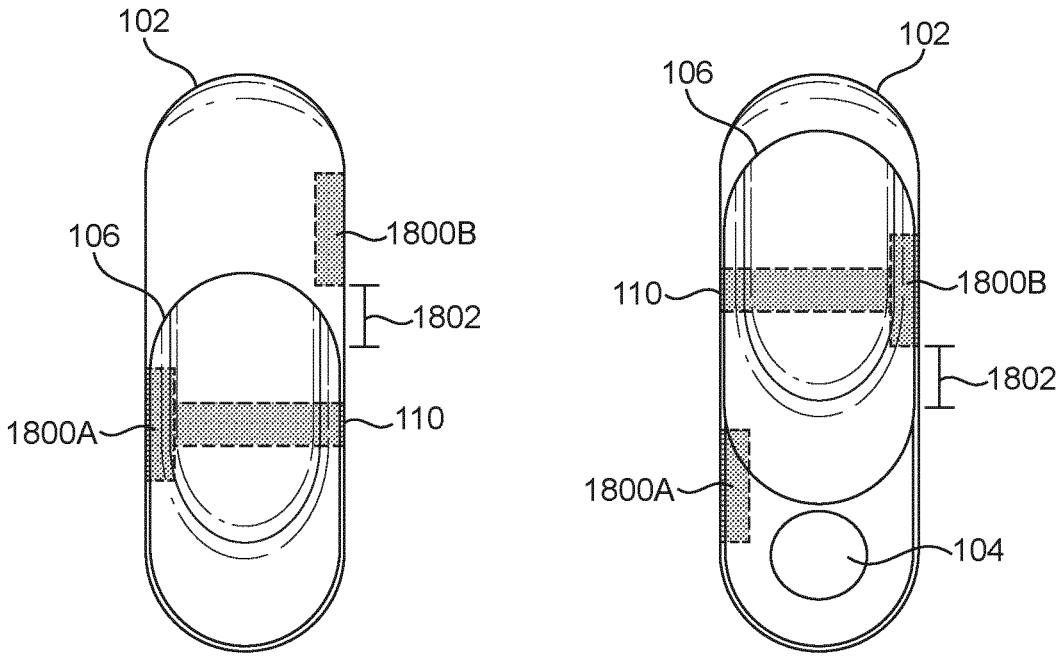
FIG. 18 is a schematic plan view of a closure according to an eighteenth embodiment of the disclosure, with the closure in a first, a second and a third position.

In an eighteenth embodiment, with reference to FIG. 18, the sensor 110 is an electrical connection. The aerosol generation device 100 of the eighteenth embodiment is identical to the aerosol generation device 100 of the first embodiment described with reference to FIGS. 1A to 1E, except where explained below, and the same reference numerals are used to refer to similar features.

In this embodiment shown in FIG. 18, the sensor 110 comprises an electrical contact arrangement. The sensing element comprises two, e.g. first and second, conductive elements 1800A and 18006. In this embodiment, the first and second conductive elements 1800A, 18006 are metal strips.

When the closure 106 is in the first position, as shown on the left image in FIG. 18, the sensor 110 detects contact with the first conductive element 1800A. When the closure 106 is in the second position, as shown in the right image in FIG. 18, the sensor 110 detects contact with the second conductive element 18006. In this embodiment, there is a gap 1802 between the two conductive elements 1800A, 1800B.

This gap 1802 is to ensure that only one of the conductive elements 1800A, 1800B makes a connection with the sensor 110 at a time. With this system, the detector is able to detect when the closure 106 is in the first or second position.

In an alternative embodiment, the gap 1802 is not used. Or alternatively described, the gap 1802 has a length of 0 mm. In a further alternative embodiment, the conductive elements 1800A, 1800B partially overlap at an intermediate position, and the detector only indicates that the first or second position has been reached when contact with only one of the conductive elements 1800A, 18006 is indicated by the sensor 110. In a further alternative embodiment, an additional conductive element (not shown) is used. In this embodiment, the third position of the closure 106 is further along the same axis as the first and second positions and placed beyond the second position. The additional conductive element is located beyond the second conductive element 1800B corresponding to the second position. When the electrical continuity detector 110 detects contact with the further conductive element the aerosol generation device 100 will move into the activation mode as described with reference to FIG. 1A to 1F.

Nineteenth Embodiment

Figure 19:
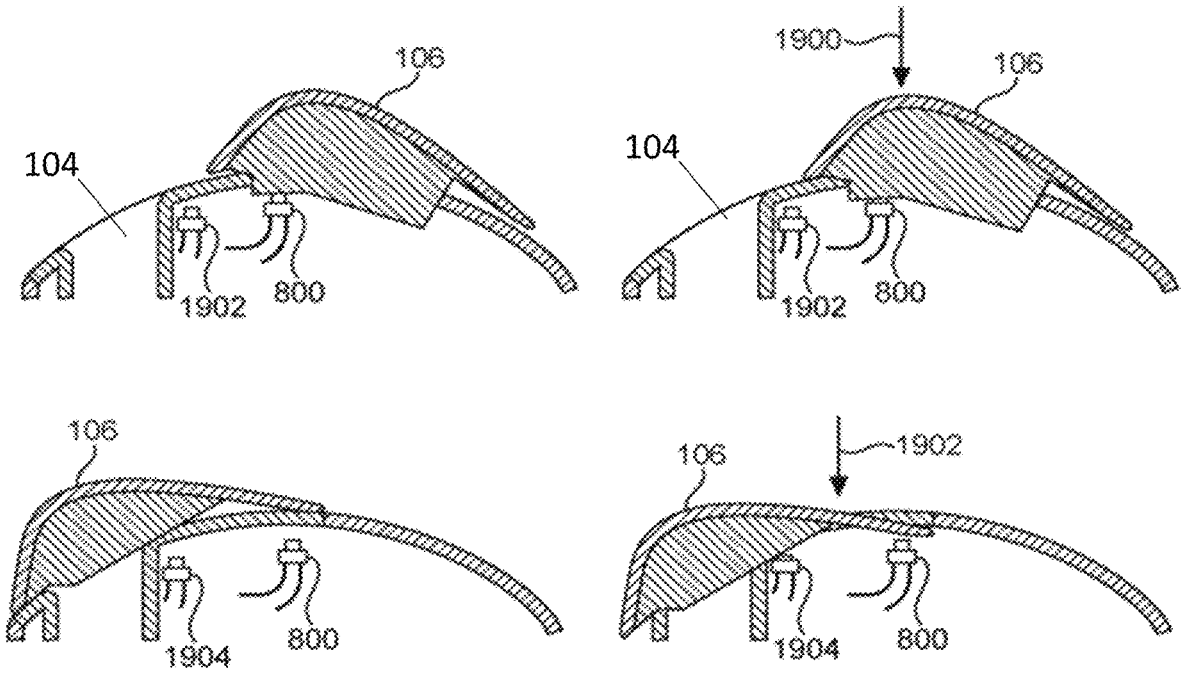
FIG. 19 is a schematic cross-sectional view of a closure and assembly according to a nineteenth embodiment of the disclosure, with the closure in a second, a third, a fourth and a first position (clockwise starting from the top left).

In a nineteenth embodiment, with reference to FIG. 19, the closure 106 has a further or fourth position. The aerosol generation device 100 of the nineteenth embodiment is identical to the aerosol generation device 100 of the first or eighth embodiment described with reference to FIGS. 1A to 1E or 8, except where explained below, and the same reference numerals are used to refer to similar features.

In this embodiment, the fourth position of the closure 106 is shown in the bottom right image of FIG. 19. The closure 106 is moved into the fourth position by a user pressing the closure 106 down (in the direction of arrow 1902) when the closure is in the first position. The closure 106 is moved into the third position (in the direction of arrow 1900) by a user pressing down the closure 106 when the closure 106 is in the second position.

Similar to the embodiment described with reference to FIG. 8, the aerosol generation device 100 comprises an activation sensor 800 to detect when the closure 106 is in the third position. The aerosol generation device 100 of this embodiment further comprises a further activation sensor 1904. The further activation sensor 1904 functions similarly to the activation sensor 800. In the preferred embodiment of FIG. 19, the activation sensor 800 and further activation sensor 1900 are tactile switches. It will be appreciated that any combination of the activation sensors 800 as described with reference to FIGS. 8 to 17 may be used in place of the tactile switches.

When the closure 106 is in the fourth position, the aerosol generation device 100 is configured to into a "status" mode. In the "status" mode, the aerosol generation device 100 is configured to display a status of the aerosol generation device 100 using the user interface display 164. The status to be displayed can be any one or more of the following: battery level, remaining time for aerosol generation device 100 usage and/or consumable remaining.

To go into the "status" mode, the closure 106 need not stay in the fourth position for any specific duration. In the present embodiment, the user moves the closure 106 into the fourth position only briefly; the detector module 160 detects the movement or position of the closure 106 and moves the aerosol generation device 100 into the status mode for a period of time. Alternatively the mode will change when the closure 106 is moved into another position. The status mode is entered when the detector module 160 receives signals from the detector in any one or more of these following cases:

- the closure 106 moves into the fourth position from the first position,
- the closure 106 moves into the fourth position from the second position,
- the closure 106 moves into the fourth position from the third position,
- the closure 106 moves into the first position from the fourth position,
- the closure 106 is in the fourth position,
- the closure 106 is in the fourth position for greater than a threshold amount of time, or
- the closure 106 is in the fourth position for greater than a threshold amount of time and less than a further threshold amount of time.

Alternatively, instead of the "status" mode, the fourth position is used to trigger the aerosol generation device 100 to turn on and off. In a further alternative, the further activation sensor is an on/off switch.

In the preferred embodiment, an electrical contact sensor is used to detect whether the closure 106 is in the first or second position. The electrical contact sensor functions as described with reference to embodiment eighteen and FIG. 18. In an alternative embodiment, any of the contactless sensors as described with reference to FIGS. 2 to 7 may be used.

In an alternative embodiment, the activation sensor 800 and further activation sensor 1900 are replaced by the capacitive sensor as described with reference to FIG. and the tenth embodiment. With this arrangement, only one sensor is used for detecting movement into the activation position or further activation position. The detector determines movement of the closure 106 into the activation position by first detecting the closure 106 in the second position, then detection of the capacitive sensor being used. Similarly, the detector determines movement of the closure 106 into the further activation position by first detecting the closure 106 in the first position, then detection of the capacitive sensor being used. In this way, the capacitive sensor is acting as the activation sensor 800 and the further activation sensor 1900. Alternatively described, the capacitive sensor is the activation sensor 800 and the activation sensor 800 is configured to detect both the activation position and further activation position of the closure 106.

ALTERNATIVE EMBODIMENTS

A person skilled in the art will appreciate that many different combinations of embodiments described with reference to FIGS. 2 to 7 may be used with the embodiments described with reference to FIG. 8 to 17 or 19 and/or the embodiments described with reference to FIGS. 2 to 19 may be used alone unmodified and/or modified to be configured to detect the three positions of the closure 106.

The aerosol generation device 100 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The described embodiments of the invention are only examples of how the invention may be implemented. Modifications, variations and changes to the described embodiments will occur to those having appropriate skills and knowledge. These modifications, variations and changes may be made without departure from the scope of the claims.

The invention claimed is:

1. An aerosol generation device comprising:

a casing;

an aperture in the casing through which aerosol generating material is insertable into the aerosol generation device;

a closure moveable relative to the aperture between a closed position in which the closure covers the aperture, an open position in which the aperture is unobstructed by the closure, and an activation position that is different from the open position and the closed position; and a detector arranged to detect movement of the closure from the closed position to the open position and between the open position and the activation position.

2. The aerosol generation device of claim 1, wherein the detector is configured to interact with a sensing element to perform detection.

3. The aerosol generation device of claim 2, wherein the detector comprises a contactless sensor for detecting at least one of the movement of the closure from the closed position to the open position or from the open position to the activation position contactlessly.

4. The aerosol generation device of claim 3, wherein the contactless sensor is a Hall effect sensor and the sensing element comprises one or more magnetic elements.

5. The aerosol generation device of claim 3, wherein the contactless sensor is a photodetector and the sensing element is the closure and the closure covers the detector in the open position.

6. The aerosol generation device of claim 3, wherein the closure or the casing has an acoustic element arranged to emit a sound when the closure moves from the closed position to the open position, and the contactless sensor is an acoustic sensor.

7. The aerosol generation device of claim 3, wherein the contactless sensor is a light responsive proximity sensor, and the sensing element is at least one light reflective element.

8. The aerosol generation device of claim 3, wherein the contactless sensor is an inductive sensor and the sensing element is at least one conductive element.

9. The aerosol generation device of claim 3, wherein the contactless sensor is an ultrasound sensor and the sensing element is at least one acoustically reflective element.

10. The aerosol generation device of claim 1, wherein the detector comprises an activation sensor configured to detect the movement of the closure from the open position to the activation position, the movement of the closure from the activation position to the open position, or when the closure is in the activation position.

11. The aerosol generation device of claim 10, wherein the activation sensor is any one of: a tactile switch, a slider switch, a force sensitive resistor, a capacitive touch sensor, a rotary encoder, a Hall effect sensor, two Hall effect sensors, a rocker switch, or an electrical contact detector.

12. The aerosol generation device of claim 1, further comprising a detector module configured to receive signals from the detector indicative of the position of the closure.

13. The aerosol generation device of claim 12, wherein the aerosol generation device is configured to be in an off mode when the closure is in the closed position, to be in a standby mode when the closure is in the open position or moves to the open position, and to be in an activation mode when the closure is in the activation position or moves to or returns from the activation position.

14. The aerosol generation device of claim 13, wherein, when in the standby mode, the aerosol generation device comprises a user interface display to display a current battery level.

15. The aerosol generation device of claim 13, wherein when in the activation mode, the aerosol generation device is configured to permit heating of aerosol generating material loaded via the aperture.

16. The aerosol generation device of claim 1, wherein the closure is moveable to a further activation position, and the detector is arranged to detect movement to or from the further activation position.

17. The aerosol generation device of claim 16, wherein the detector comprises a further activation sensor configured to detect movement of the closure from the closed position to the further activation position, movement of the closure from the further activation position to the closed position, or when the closure is in the further activation position.

* * * * *